US008977546B2

(12) United States Patent
Oshikiri

(10) Patent No.: US 8,977,546 B2
(45) **Date of Patent: *Mar. 10, 2015**

(54) ENCODING DEVICE, DECODING DEVICE AND METHOD FOR BOTH

(75) Inventor: Masahiro Oshikiri, Kanagawa (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 422 days.

This patent is subject to a terminal disclaimer.

(21) Appl. No.: 13/502,407

(22) PCT Filed: Oct. 19, 2010

(86) PCT No.: PCT/JP2010/006195

§ 371 (c)(1),
(2), (4) Date: Apr. 17, 2012

(87) PCT Pub. No.: WO2011/048798

PCT Pub. Date: Apr. 28, 2011

(65) Prior Publication Data

US 2012/0209596 A1 Aug. 16, 2012

(30) Foreign Application Priority Data

Oct. 20, 2009 (JP) ..... 2009-241617

(51) Int. Cl.
*G10L 19/00* (2013.01)
*G10L 19/06* (2013.01)
(Continued)

(52) U.S. Cl.
CPC ..... *G10L 19/06* (2013.01); *G10L 19/02* (2013.01); *G10L 19/025* (2013.01); *G10L 19/24* (2013.01)
USPC ..... 704/230; 704/219; 704/500; 704/225; 704/229; 370/401; 370/468; 375/240.11; 700/94

(58) Field of Classification Search
CPC ..... G10L 19/0208; G10L 19/00; G10L 19/24; G10L 19/0212
USPC ..... 704/205, 230, 500–504, 203, 207, 225, 704/229, 219, 226–228; 370/401, 468; 375/240.11; 700/94
See application file for complete search history.

(56) References Cited

U.S. PATENT DOCUMENTS 5,825,320 A 10/1998 Miyamori et al.
6,640,145 B2 * 10/2003 Hoffberg et al. ..... 700/83
(Continued)

FOREIGN PATENT DOCUMENTS

JP 9-261063 10/1997
JP 2003-233400 8/2003
(Continued)

OTHER PUBLICATIONS

Miki, S., "All About MPEG-4", Kogyo Chosakai Publishing Co., Ltd., Sep. 30, 1998, pp. 126-127.

*Primary Examiner* — Vijay B Chawan
(74) *Attorney, Agent, or Firm* — Greenblum & Bernstein, P.L.C.

(57) ABSTRACT

Disclosed are an encoding device and a decoding device which suppress the occurrence of pre-echo artifacts and post-echo artifacts caused by a high layer having a low temporal resolution, and which implement high subjective quality encoding and decoding. An encoding device (100) carries out scalable coding comprising a low layer, and a high layer having a lower temporal resolution than that of the low layer. A start point detection unit (or end point detection unit) (150) determines the start point (or end point) of sections of the decoded low layer signal which have audio, and when the start point (or end point) is determined, a second layer encoding unit (160) selects a bandwidth to be excluded from encoding on the basis of the spectral energy from the decoded first layer signal, excludes the selected bandwidth, and encodes an error signal.

19 Claims, 24 Drawing Sheets

(51) Int. Cl.

| | |
|---|---|
| ***G10L 19/02*** | (2013.01) |
| ***G10L 19/24*** | (2013.01) |
| *G10L 19/025* | (2013.01) |

(56) References Cited

U.S. PATENT DOCUMENTS

| | | | | |
|---|---|---|---|---|
| 7,006,881 | B1 * | 2/2006 | Hoffberg et al. | 700/83 |
| 7,904,292 | B2 | 3/2011 | Goto et al. | |
| 7,983,904 | B2 | 7/2011 | Ehara et al. | |
| 8,010,349 | B2 | 8/2011 | Oshikiri | |
| 8,019,597 | B2 | 9/2011 | Oshikiri | |
| 8,543,392 | B2 * | 9/2013 | Oshikiri et al. | 704/230 |
| 8,554,549 | B2 * | 10/2013 | Oshikiri et al. | 704/223 |
| 2003/0154074 | A1 | 8/2003 | Kikuiri et al. | |
| 2007/0282604 | A1 | 12/2007 | Gartner et al. | |
| 2010/0017200 | A1 | 1/2010 | Oshikiri et al. | |

FOREIGN PATENT DOCUMENTS

| | | |
|---|---|---|
| JP | 2005-12543 | 1/2005 |
| JP | 2008-539456 | 11/2008 |
| WO | 2008/120437 | 10/2008 |

* cited by examiner

ENCODING DEVICE, DECODING DEVICE AND METHOD FOR BOTH

TECHNICAL FIELD

The present invention relates to a coding apparatus, a decoding apparatus, a coding method, and a decoding method for implementing scalable coding (layer coding).

BACKGROUND ART

Mobile communication systems are required to compress and transmit speech signals at a low bit rate, in order to effectively utilize radio wave resources. At the same time, the mobile communication systems are required to improve the quality of telephone speech and provide telephone services enabling vivid communication. To achieve this, it is desirable to not only improve the quality of speech signals but also encode, with high quality, even signals other than the speech signals, such as music signals having a wider bandwidth.

A promising technique for approaching these two contradictory requirements involves hierarchically integrating a plurality of coding techniques. This technique uses a hierarchical combination of a first layer and a second layer: the first layer encodes an input signal at a low bit rate on the basis of a model suited to a speech signal, and the second layer encodes a differential signal between the input signal and a decoded signal of the first layer on the basis of a model suited to signals other than the speech signal. Such technique of hierarchical coding is generally referred to as scalable coding (layer coding) because a bit stream obtained by a coding apparatus exhibits scalability, or a property that a decoded signal can be obtained even from information on part of the bit stream.

Such scalable coding system can flexibly deal with communication between networks having different bit rates in its nature, and thus can be regarded as suitable for future network environments in which variety of networks will be integrated through IP protocols.

A technique is disclosed in NPL 1 as an example in which the scalable coding is implemented using a technique standardized by Moving Picture Experts Group phase-4 (MPEG-4). This technique uses, in a first layer, code excited linear prediction (CELP) coding suited to a speech signal, and in a second layer, transform coding, such as advanced audio coder (AAC) or transform domain weighted interleave vector quantization (TwinVQ), is performed on a residual signal obtained by subtracting a first layer decoded signal from the original signal.

With the use of such a scalable configuration, the quality of speech signals and the quality of music signals and other such signals having a wider bandwidth than that of the speech signals can be improved.

In the case where the transform coding is applied to at least one layer in the layer coding as described above, coding distortion that is caused by the transform coding at the start point (or the end point) of the speech signal propagates over an entire frame, and this coding distortion unfavorably decreases the sound quality. The coding distortion caused at this time is referred to as pre-echo (or post-echo).

FIG. 1 shows a state where a decoded signal is generated in the case of encoding and decoding the start point of a speech signal with the use of scalable coding including two layers. Here, the first layer adopts CELP in which an excitation signal is encoded for each sub-frame of 5 ms, and the second layer adopts transform coding performed for each frame of 20 ms.

In the case as the first layer where the time length of a signal as a coding target is as short as 5 ms, the coding interval is short, and hence such a case is hereinafter referred to as "the temporal resolution is high". In the case as the second layer where the time length of a signal as a coding target is as long as 20 ms, the coding interval is long, and hence such a case is hereinafter referred to as "the temporal resolution is low".

In the first layer, a decoded signal can be generated on a 5-ms basis, and hence the propagation of coding distortion falls within merely 5 ms (see FIG. 1(*a*)). On the other hand, in the second layer, coding distortion propagates in a wide range of 20 ms. Originally, the first half part of this frame corresponds to inactive speech, and a second layer decoded signal needs to be generated only in the latter half part of this frame. Nevertheless, if the bit rate cannot be made sufficiently high, a waveform appears also in the first half part due to the coding distortion (see FIG. 1(*b*)). In general, in order to obtain high coding efficiency in the transform coding, the frame length needs to be set to 20 ms or more. Accordingly, the temporal resolution is lower than that of CELP, which is disadvantageous.

When a final decoded signal is calculated by adding the first layer decoded signal to the second layer decoded signal, the coding distortion remains in section A of the decoded signal (see FIG. 1(*c*)), resulting in a decrease in sound quality. Such a phenomenon occurs at the start point of a speech signal (or a music signal), and this coding distortion is referred to as pre-echo. Note that similar coding distortion occurs also at the end point of a speech signal (or a music signal), and this coding distortion is referred to as post-echo.

A method for avoiding the occurrence of such pre-echoes involves detecting the start point of a speech signal and switching, if the start point is detected, to a process of making the frame length (analysis length) of transform coding shorter. PTL 1 discloses a start point detecting method in which: the start point of a speech signal is detected on the basis of a temporal change in gain information of CELP in a first layer; and information on the detected start point is reported to a second layer.

In this way, the temporal resolution is increased by making the analysis length at the start point shorter. As a result, the propagation of coding distortion can be suppressed to be low, and the occurrence of pre-echoes can be avoided.

The above-mentioned method, however, requires switching of the analysis lengths, a frequency transforming method suited to the two analysis lengths, and a quantization method for transform coefficients, and hence the complexity of processing is unfavorably increased.

In addition, PTL 1 does not disclose a specific method for avoiding pre-echoes using information on the detected start point, and hence the pre-echoes cannot be avoided.

Meanwhile, PTL 2 discloses a method for avoiding the occurrence of pre-echoes, the method in which an amplification factor by which each decoded signal is to be multiplied is obtained on the basis of an energy envelope relation of the decoded signals of a first layer and a second layer; and each decoded signal is multiplied by the obtained amplification factor.

CITATION LIST

Patent Literature

PTL 1
Japanese Patent Application Laid-Open No. 2003-233400
PTL 2
National Publication of International Patent Application No. 2008-539456

Non-Patent Literature

NPL 1
"All about MPEG-4" written and edited by Sukeichi MIKI, First Edition, Kogyo Chosakai Publishing Co., Ltd., Sep. 30, 1998, pp. 126-127

SUMMARY OF INVENTION

Technical Problem

Unfortunately, according to the method described in PTL 2, part of the decoded signal of the second layer is significantly attenuated after encoding in the second layer, and hence part of encoded data of the second layer is wasted, which is not efficient.

The present invention has an object to provide a coding apparatus, a decoding apparatus, a coding method, and a decoding method for suppressing the occurrence of pre-echoes or post-echoes caused by a higher layer having low temporal resolution, to thereby implement coding and decoding with high subjective quality.

Solution to Problem

An aspect of the present invention provides a coding apparatus for scalable coding including: a lower layer; and a higher layer having temporal resolution lower than temporal resolution of the lower layer, the coding apparatus including: a lower layer coding section that encodes an input signal to obtain a lower layer encoded signal; a lower layer decoding section that decodes the lower layer encoded signal to obtain a lower layer decoded signal; an error signal generating section that obtains an error signal between the input signal and the lower layer decoded signal; a determining section that determines a start point or an end point of an active speech portion in the lower layer decoded signal; and a higher layer coding section that selects, if the determining section determines the start point or the end point, a band to be excluded from coding target bands, excludes the selected band to encode the error signal, and obtains a higher layer encoded signal.

An aspect of the present invention provides a decoding apparatus for decoding a lower layer encoded signal and a higher layer encoded signal that are encoded by a coding apparatus for scalable coding including: a lower layer; and a higher layer having temporal resolution lower than temporal resolution of the lower layer, the decoding apparatus including: a lower layer decoding section that decodes the lower layer encoded signal to obtain a lower layer decoded signal; a higher layer decoding section that excludes or processes a band selected on a basis of a preset condition to decode the higher layer encoded signal, and obtains a decoded error signal; and an adding section that adds the lower layer decoded signal to the decoded error signal to obtain a decoded signal.

An aspect of the present invention provides a coding method for scalable coding including: a lower layer; and a higher layer having temporal resolution lower than temporal resolution of the lower layer, the coding method including: a lower layer coding step of encoding an input signal to obtain a lower layer encoded signal; a lower layer decoding step of decoding the lower layer encoded signal to obtain a lower layer decoded signal; an error signal generating step of obtaining an error signal between the input signal and the lower layer decoded signal; a determining step of determining a start point or an end point of an active speech portion in the lower layer decoded signal; and a higher layer coding step of selecting, if the start point or the end point is determined in the determining step, a band to be excluded from coding target bands, excluding the selected band to encode the error signal, and obtaining a higher layer encoded signal.

An aspect of the present invention provides a decoding method for decoding a lower layer encoded signal and a higher layer encoded signal that are encoded by a coding method for scalable coding including: a lower layer; and a higher layer having temporal resolution lower than temporal resolution of the lower layer, the decoding method including: a lower layer decoding step of decoding the lower layer encoded signal to obtain a lower layer decoded signal; a higher layer decoding step of excluding or processing a band selected on a basis of a preset condition to decode the higher layer encoded signal, and obtaining a decoded error signal; and an adding step of adding the lower layer decoded signal to the decoded error signal to obtain a decoded signal.

Advantageous Effects of Invention

According to the present invention, it is possible to suppress the occurrence of pre-echoes or post-echoes caused by a higher layer having low temporal resolution, to thereby implement coding and decoding with high subjective quality.

DESCRIPTION OF EMBODIMENTS

Now, embodiments of the present invention will be described in detail with reference to the drawings.

(Embodiment 1)

Figure 2:
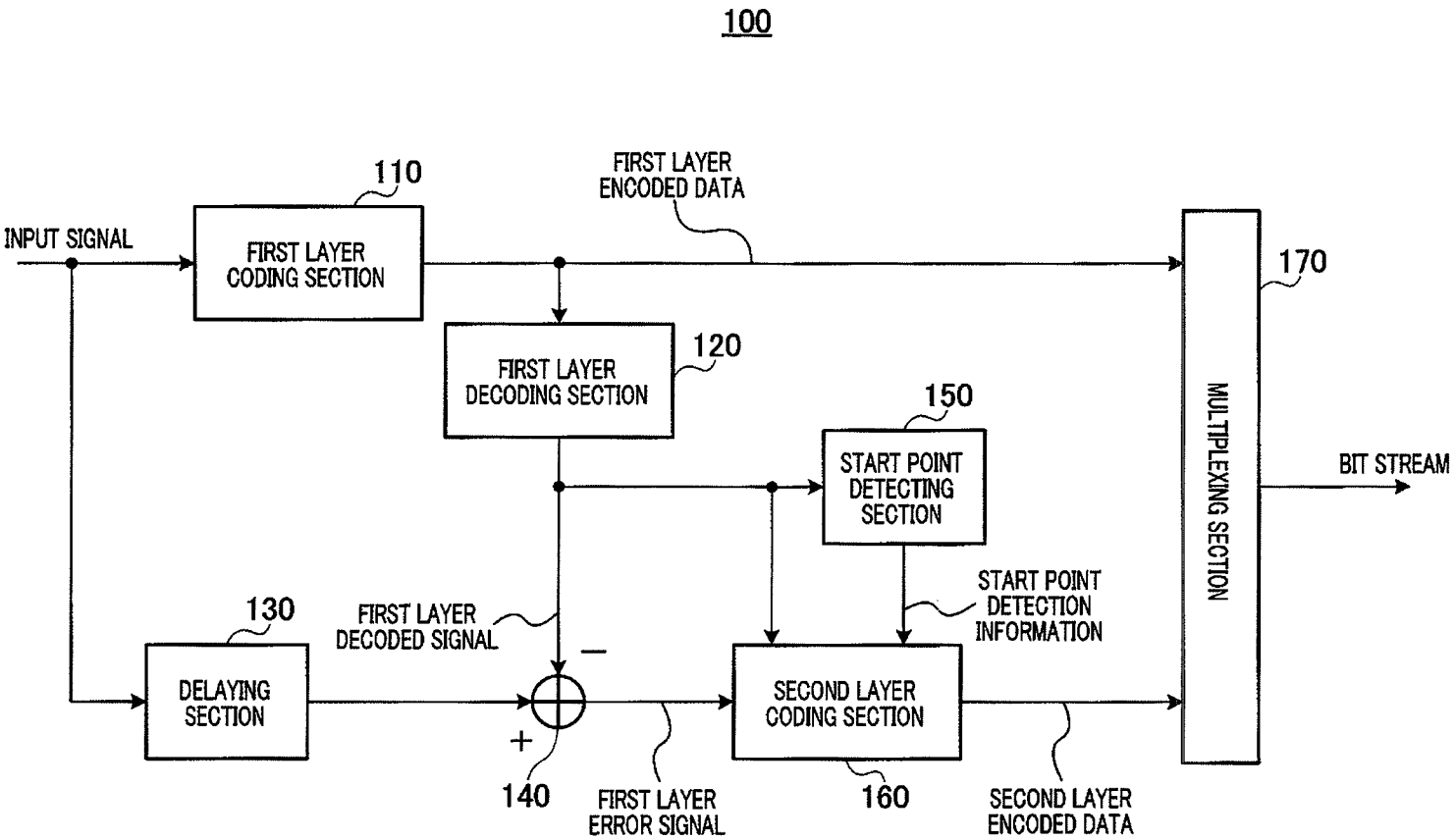
FIG. 2 is a diagram showing a main part configuration of a coding apparatus according to Embodiment 1 of the present invention.

FIG. 2 is a diagram showing a main part configuration of a coding apparatus according to the present embodiment. Coding apparatus 100 of FIG. 2 is assumed as a scalable coding (layer coding) apparatus including two coding layers as an example. Note that the number of layers is not limited to two.

Coding apparatus 100 shown in FIG. 2 performs a coding process on a predetermined time interval (frame; here, assumed as 20 ms) basis, generates a bit stream, and transmits the bit stream to a decoding apparatus (not shown).

First layer coding section 110 performs a coding process of an input signal, and generates first layer encoded data. Note that first layer coding section 110 performs coding with high temporal resolution. First layer coding section 110 adopts, as a coding method, for example, a CELP coding system in which each frame is divided into sub-frames of 5 ms and excitation is encoded on a sub-frame basis. First layer coding section 110 outputs the first layer encoded data to first layer decoding section 120 and multiplexing section 170.

First layer decoding section 120 performs a decoding process using the first layer encoded data, generates a first layer decoded signal, and outputs the generated first layer decoded signal to subtracting section 140, start point detecting section 150, and second layer coding section 160.

Delaying section 130 delays the input signal by an amount of time corresponding to a delay that occurs in first layer coding section 110 and first layer decoding section 120, and outputs the delayed input signal to subtracting section 140.

Subtracting section 140 subtracts, from the input signal, the first layer decoded signal generated by first layer decoding section 120 to thereby generate a first layer error signal, and outputs the first layer error signal to second layer coding section 160.

Start point detecting section 150 detects, using the first layer decoded signal, whether or not the signal contained in the frame that is currently subjected to the coding process is the start point of an active speech portion such as a speech signal or a music signal, and outputs the detection result as start point detection information to second layer coding section 160. Note that the detail of start point detecting section 150 is described later.

Second layer coding section 160 performs a coding process of the first layer error signal sent out from subtracting section 140, and generates second layer encoded data. Note that second layer coding section 160 performs coding with temporal resolution lower than that of first layer coding section 110. For example, second layer coding section 160 adopts a transform coding system in which transform coefficients are encoded on the basis of a unit longer than the processing unit of first layer coding section 110. Note that the detail of second layer coding section 160 is described later. Second layer coding section 160 outputs the generated second layer encoded data to multiplexing section 170.

Multiplexing section 170 multiplexes the first layer encoded data obtained by first layer coding section 110 with the second layer encoded data obtained by second layer coding section 160 to thereby generate a bit stream, and outputs the generated bit stream to a transmission channel (not shown).

Figure 3:
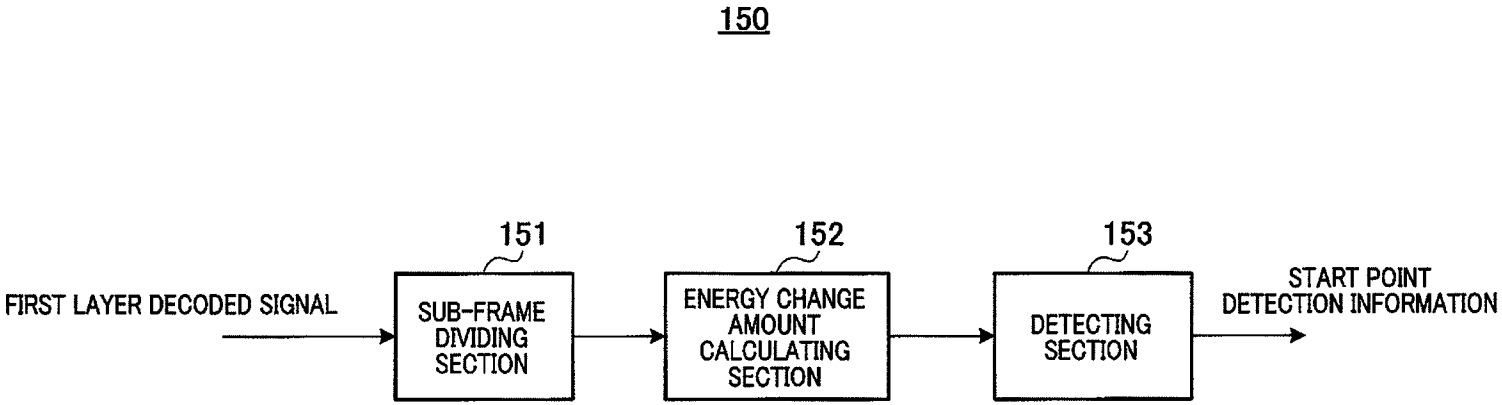
FIG. 3 is a diagram showing an internal configuration of a start point detecting section.

FIG. 3 is a diagram showing an internal configuration of start point detecting section 150.

Sub-frame dividing section 151 divides the first layer decoded signal into Nsub sub-frames. Here, Nsub represents the number of sub-frames. Hereinafter, description is given assuming that Nsub=2.

Energy change amount calculating section 152 calculates energy of the first layer decoded signal for each sub-frame.

Detecting section 153 compares the amount of change in this energy with a predetermined threshold value. If the amount of change exceeds the threshold value, detecting section 153 determines that the start point of the active speech portion is detected, and outputs 1 as the start point detection information. On the other hand, if the amount of change does not exceed the threshold value, detecting section 153 does not determine that the start point is detected, and outputs 0 as the start point detection information.

Figure 4:
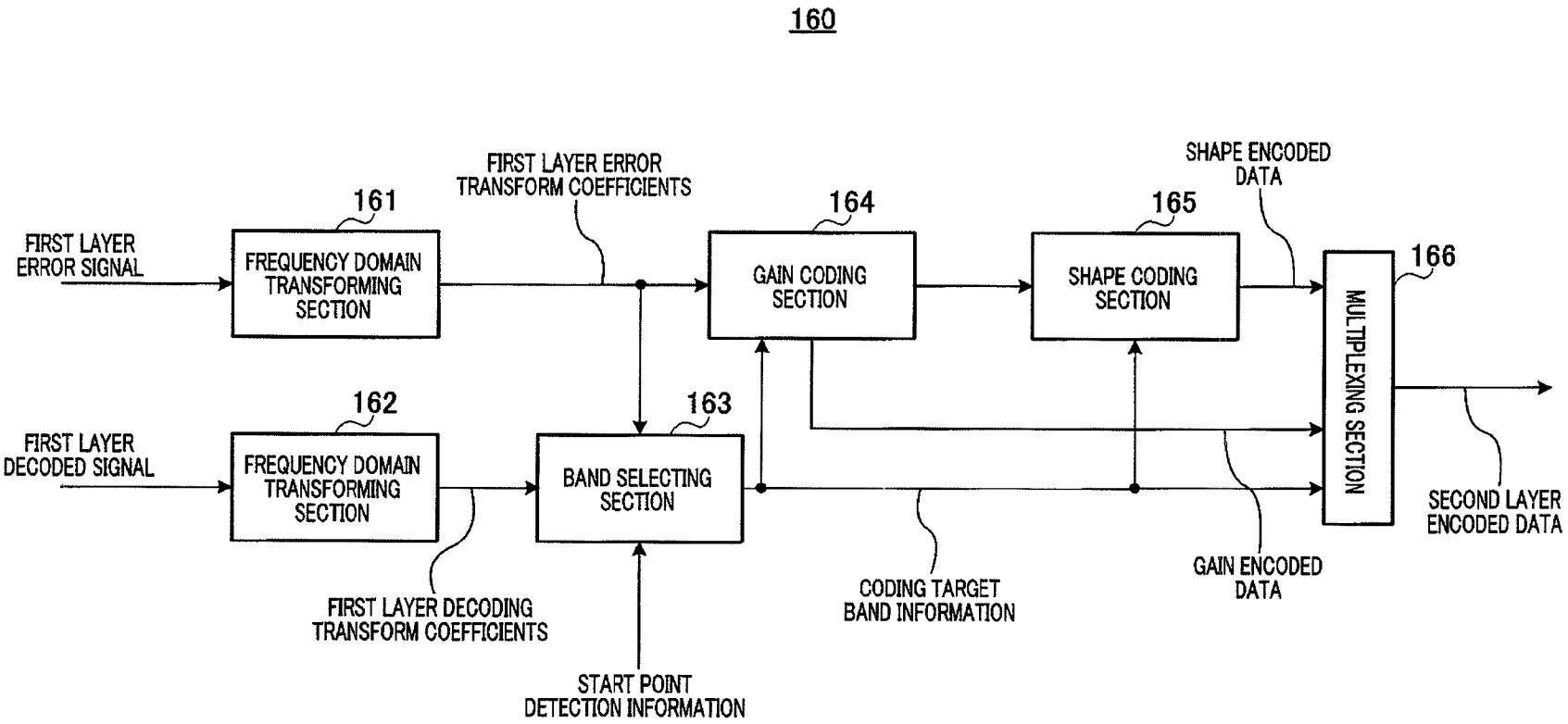
FIG. 4 is a diagram showing an internal configuration of a second layer coding section.

FIG. 4 is a diagram showing an internal configuration of second layer coding section 160.

Frequency domain transforming section 161 transforms the first layer error signal into a frequency domain, calculates first layer error transform coefficients, and outputs the calculated first layer error transform coefficients to band selecting section 163 and gain coding section 164.

Frequency domain transforming section 162 transforms the first layer decoded signal into a frequency domain, calculates first layer decoding transform coefficients, and outputs the calculated first layer decoding transform coefficients to band selecting section 163.

If the start point detection information indicates 1, that is, if the signal contained in the frame that is currently subjected to the coding process is the start point of the active speech portion, band selecting section 163 selects a sub-band to be excluded from the coding targets of gain coding section 164 and shape coding section 165 at the subsequent stage. Specifically, band selecting section 163 divides the first layer decoding transform coefficients into a plurality of sub-bands, and excludes a sub-band whose energy of the first layer decoding transform coefficients is the smallest or a sub-band whose energy thereof is smaller than a predetermined threshold value, from the coding targets of second layer coding section 160 (gain coding section 164 and shape coding section 165). Then, band selecting section 163 sets each sub-band that remains without being excluded, as an actual coding target band (second layer coding target band).

Note that band selecting section 163 may divide the first layer decoding transform coefficients and the first layer error transform coefficients into a plurality of sub-bands, and may obtain a ratio (Ee/Em) of energy (Ee) of the first layer error transform coefficients to energy (Em) of the first layer decoding transform coefficients for each sub-band. Then, band selecting section 163 may select a sub-band whose energy ratio is larger than a predetermined threshold value, as a sub-band to be excluded from the coding targets of second layer coding section 160. Alternatively, instead of the energy ratio, band selecting section 163 may obtain a ratio of the maximum amplitude value of the first layer error transform coefficients to the maximum amplitude value of the first layer decoding transform coefficients for each sub-band. Then, band selecting section 163 may select a sub-band whose maximum amplitude value ratio is larger than a predetermined threshold value, as a sub-band to be excluded from the coding targets of second layer coding section 160.

Note that band selecting section 163 may adaptively use different threshold values in accordance with characteristics (for example, speech- or music-related, or stationary or non-stationary) of the input signal.

Note that band selecting section 163 may calculate a perceptual masking threshold value corresponding to backward masking, on the basis of the first layer decoding transform coefficients, and may calculate energy of the perceptual masking threshold value for each sub-band. Then, band selecting section 163 may exclude a sub-band whose calculated energy is the smallest or a sub-band whose calculated energy is smaller than a predetermined threshold value, from the coding targets of second layer coding section 160.

Figure 5:
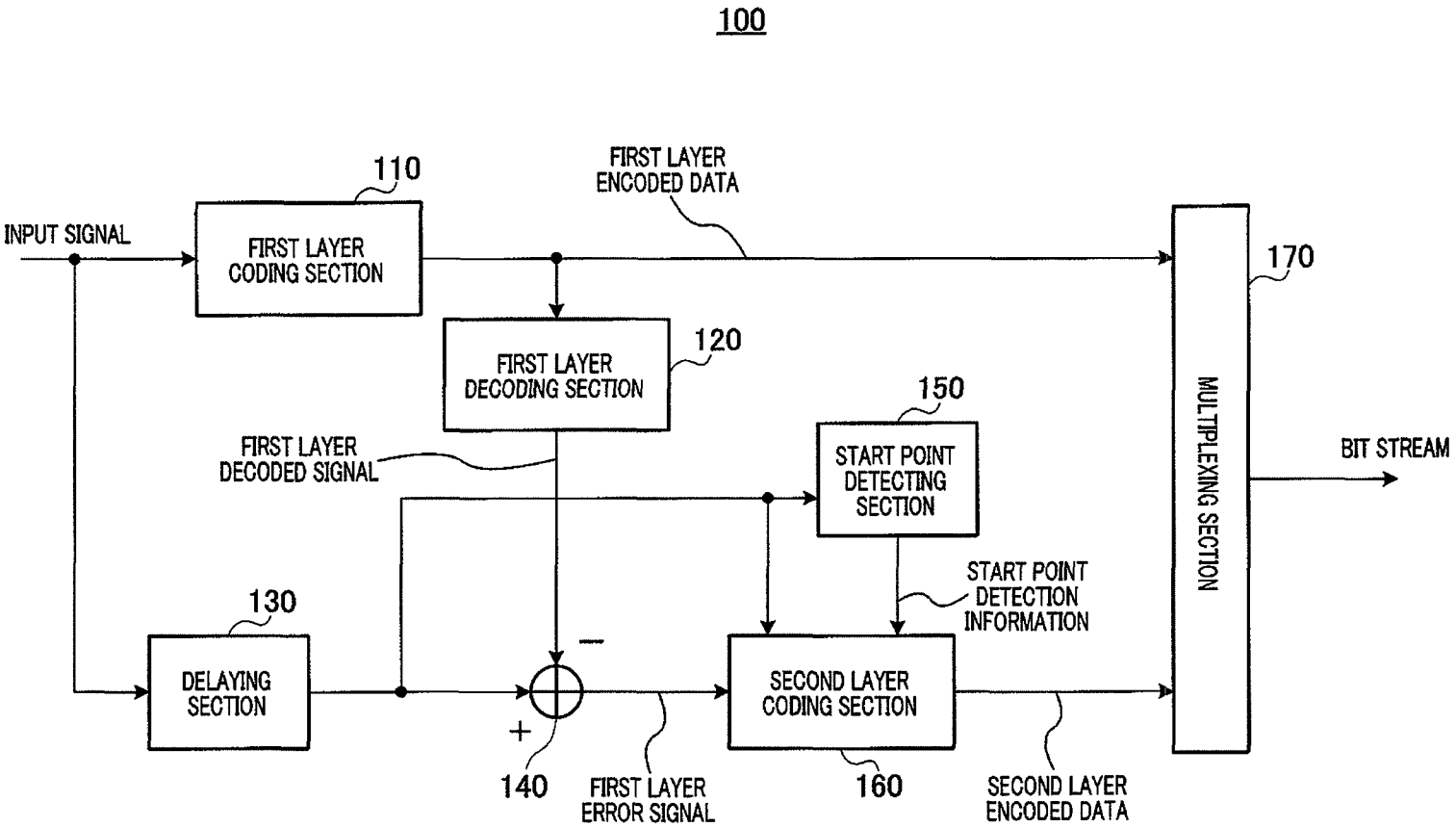
FIG. 5 is a diagram showing another main part configuration of the coding apparatus according to Embodiment 1.
Figure 6:
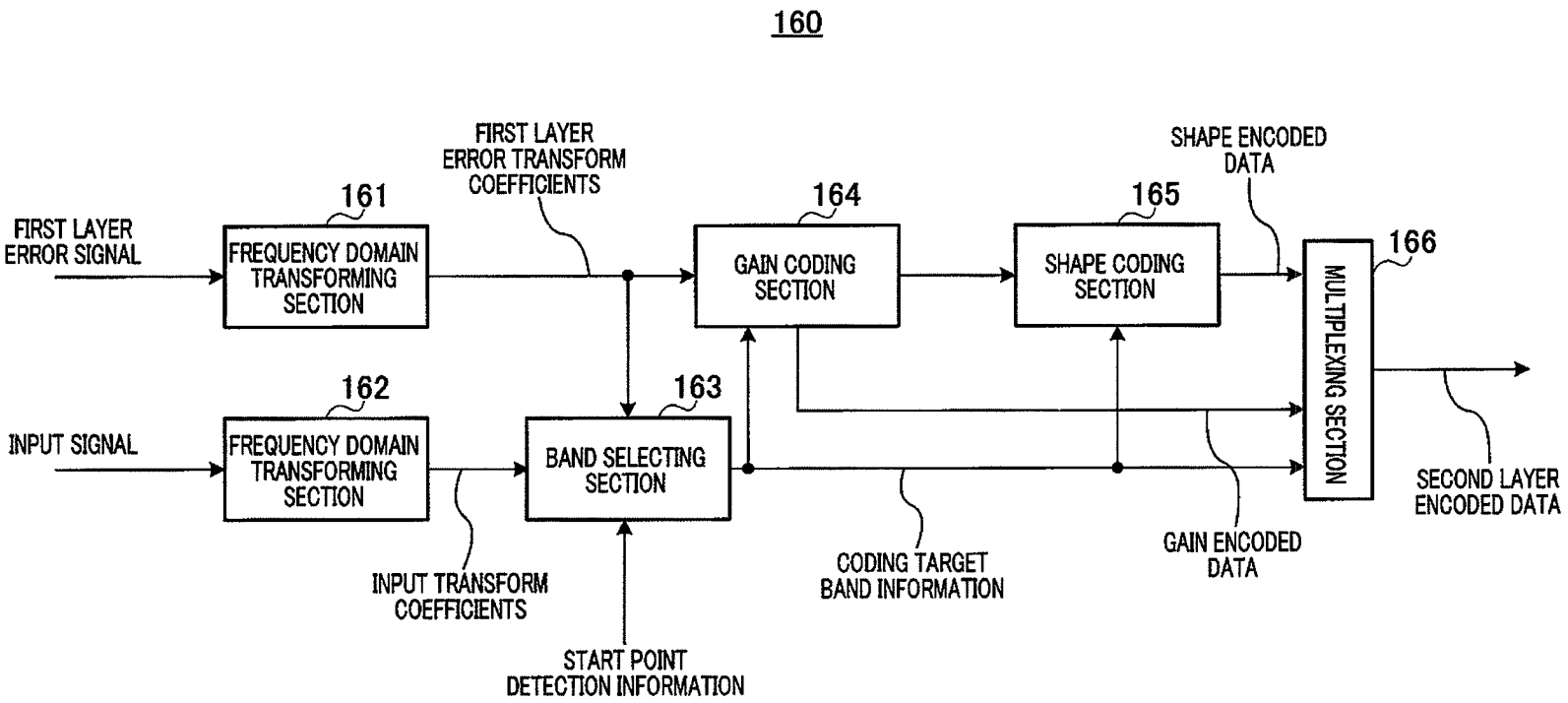
FIG. 6 is a diagram showing another internal configuration of the second layer coding section.

Note that, instead of the first layer decoding transform coefficients, band selecting section 163 may use input transform coefficients obtained by transforming the input signal into a frequency domain, to thereby determine the coding target band. The configurations of coding apparatus 100 and second layer coding section 160 in this case are respectively shown in FIG. 5 and FIG. 6.

Figure 7:
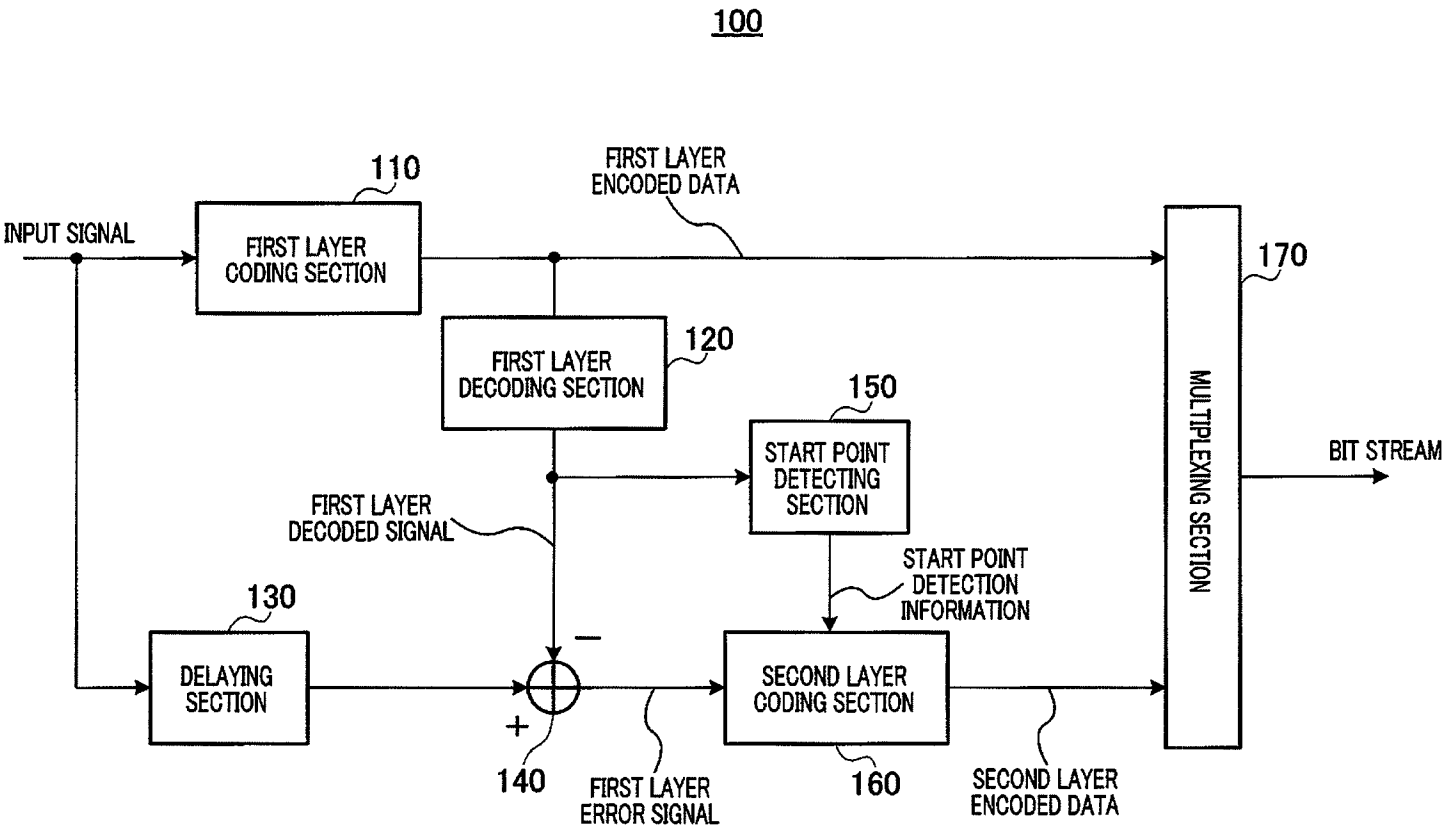
FIG. 7 is a diagram showing still another main part configuration of the coding apparatus according to Embodiment 1.
Figure 8:
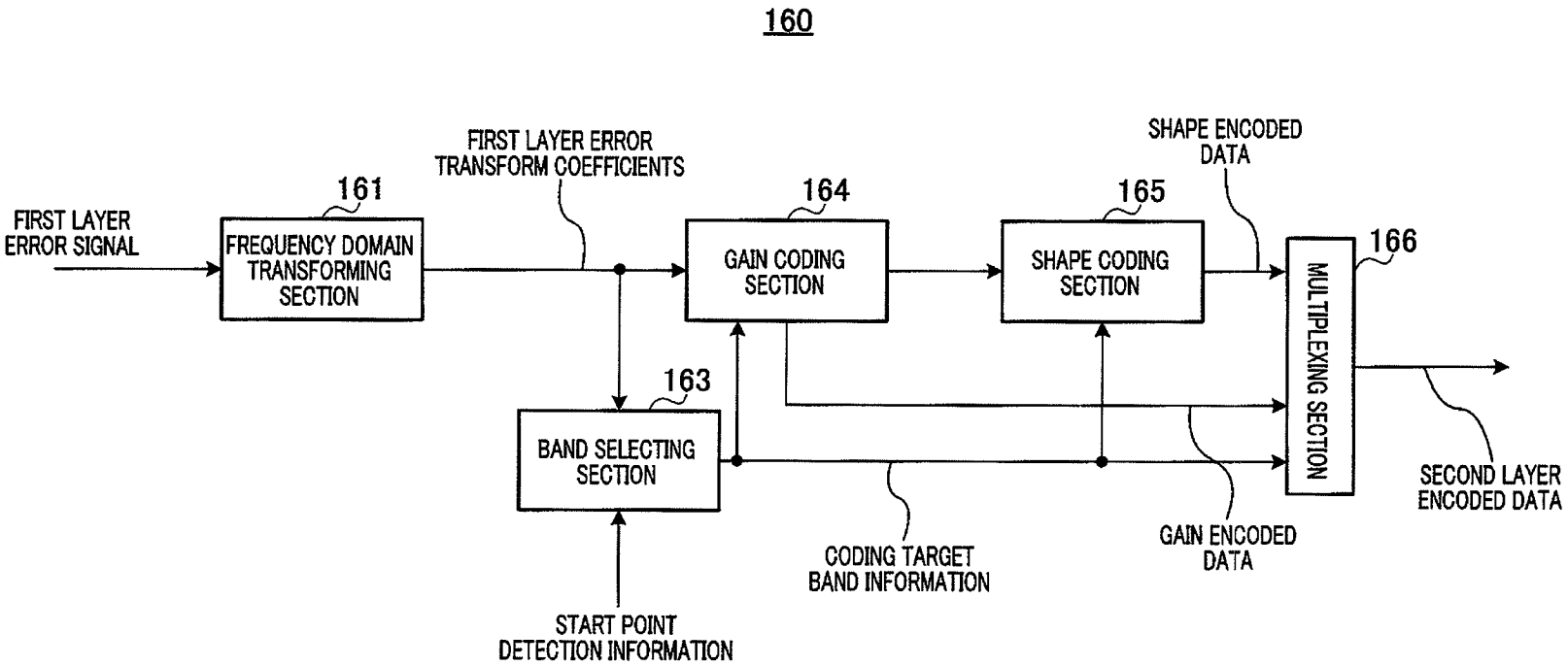
FIG. 8 is a diagram showing still another internal configuration of the second layer coding section.

Note that, without using the first layer decoding transform coefficients, band selecting section 163 may use only the first layer error transform coefficients, to thereby determine the coding target band. The configurations of coding apparatus 100 and second layer coding section 160 in this case are respectively shown in FIG. 7 and FIG. 8. This configuration can produce an effect of the present embodiment without using the first layer decoding transform coefficients, for the following reason.

That is, first layer coding section 110 performs perceptual weighting to thereby perform such a coding process that spectral characteristics of the error signal between the input signal and the first layer decoded signal approach spectral characteristics of the input signal. This perceptual weighting is performed in order to obtain an effect that makes the error signal difficult to hear perceptually. In other words, first layer coding section 110 performs such spectral shaping that the spectral characteristics of the error signal approach the spectral characteristics of the input signal. As a result, because the spectral characteristics of the error signal approach the spectral characteristics of the input signal, the effect of the present embodiment can be produced even if the error signal is used instead of the first layer decoded signal. For example, a method in which a perceptual weighting filter having characteristics close to inverse characteristics of a spectral envelope of the input signal is used on the basis of linear predictive coding (LPC) coefficients can be applied to the perceptual weighting process of first layer coding section 110.

In addition, this configuration does not need frequency domain transforming section 162, and thus can produce another effect that reduces the amount of calculation.

In this way, band selecting section 163 selects a band to be excluded from the coding targets of second layer coding section 160, and outputs information (coding target band information) indicating each band (second layer coding target band), which is other than the selected sub-band and corresponds to the coding target, to gain coding section 164, shape coding section 165, and multiplexing section 166.

Gain coding section 164 calculates gain information indicating the magnitude of the transform coefficients contained in each sub-band (second layer coding target band) reported by band selecting section 163, and encodes the gain information to thereby generate gain encoded data. Gain coding section 164 outputs the gain encoded data to multiplexing section 166. Gain coding section 164 also outputs decoding gain information obtained together with the gain encoded data, to shape coding section 165.

Shape coding section 165 generates, using the decoding gain information, shape encoded data indicating the shape of the transform coefficients contained in each sub-band (second layer coding target band) reported by band selecting section 163, and outputs the generated shape encoded data to multiplexing section 166.

Multiplexing section 166 multiplexes the coding target band information outputted by band selecting section 163, the shape encoded data outputted by shape coding section 165, and the gain encoded data outputted by gain coding section 164 with one another, and outputs the multiplexed data as the second layer encoded data. Note that multiplexing section 166 is not indispensable, and the coding target band information, the shape encoded data, and the gain encoded data may be outputted directly to multiplexing section 170.

Figure 9:
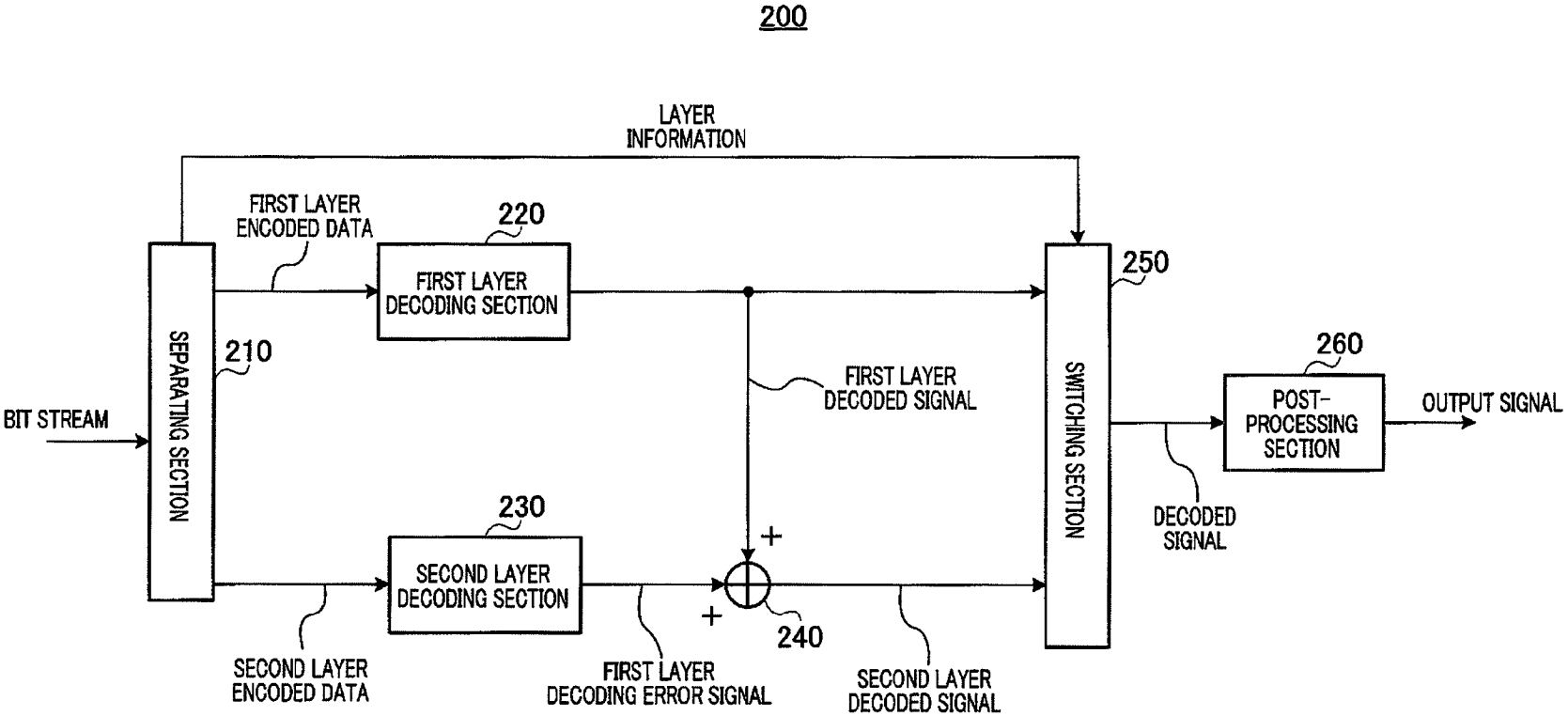
FIG. 9 is a block diagram showing a main part configuration of a decoding apparatus according to Embodiment 1.

FIG. 9 is a block diagram showing a main part configuration of a decoding apparatus according to the present embodiment. Decoding apparatus 200 of FIG. 9 decodes the bit stream outputted by coding apparatus 100 that performs the scalable coding (layer coding) including the two coding layers.

Separating section 210 separates the bit stream inputted through the transmission channel, into first layer encoded data and second layer encoded data. Separating section 210 outputs the first layer encoded data to first layer decoding section 220, and outputs the second layer encoded data to second layer decoding section 230. Unfortunately, a part (second layer encoded data) or the entirety of the encoded data may be discarded in some cases depending on conditions of the transmission channel (for example, the occurrence of congestion). At this time, separating section 210 determines whether the received encoded data contains only the first layer encoded data (layer information is 1) or contains both the first layer encoded data and the second layer encoded data (layer information is 2), and outputs the determination result as the layer information to switching section 250. If the entire encoded data is discarded, separating section 210 performs predetermined error concealment processing, and generates an output signal.

First layer decoding section 220 performs a decoding process of the first layer encoded data, generates a first layer decoded signal, and outputs the generated first layer decoded signal to adding section 240 and switching section 250.

Second layer decoding section 230 performs a decoding process of the second layer encoded data, generates a first layer decoding error signal, and outputs the generated first layer decoding error signal to adding section 240.

Adding section 240 adds the first layer decoded signal to the first layer decoding error signal to thereby generate a second layer decoded signal, and outputs the generated second layer decoded signal to switching section 250.

On the basis of the layer information given by separating section 210, if the layer information is 1, switching section 250 outputs the first layer decoded signal as a decoded signal to post-processing section 260. On the other hand, if the layer information is 2, switching section 250 outputs the second layer decoded signal as a decoded signal to post-processing section 260.

Post-processing section 260 performs post-processing such as post-filtering on the decoded signal, and outputs the processed signal as an output signal.

Figure 10:
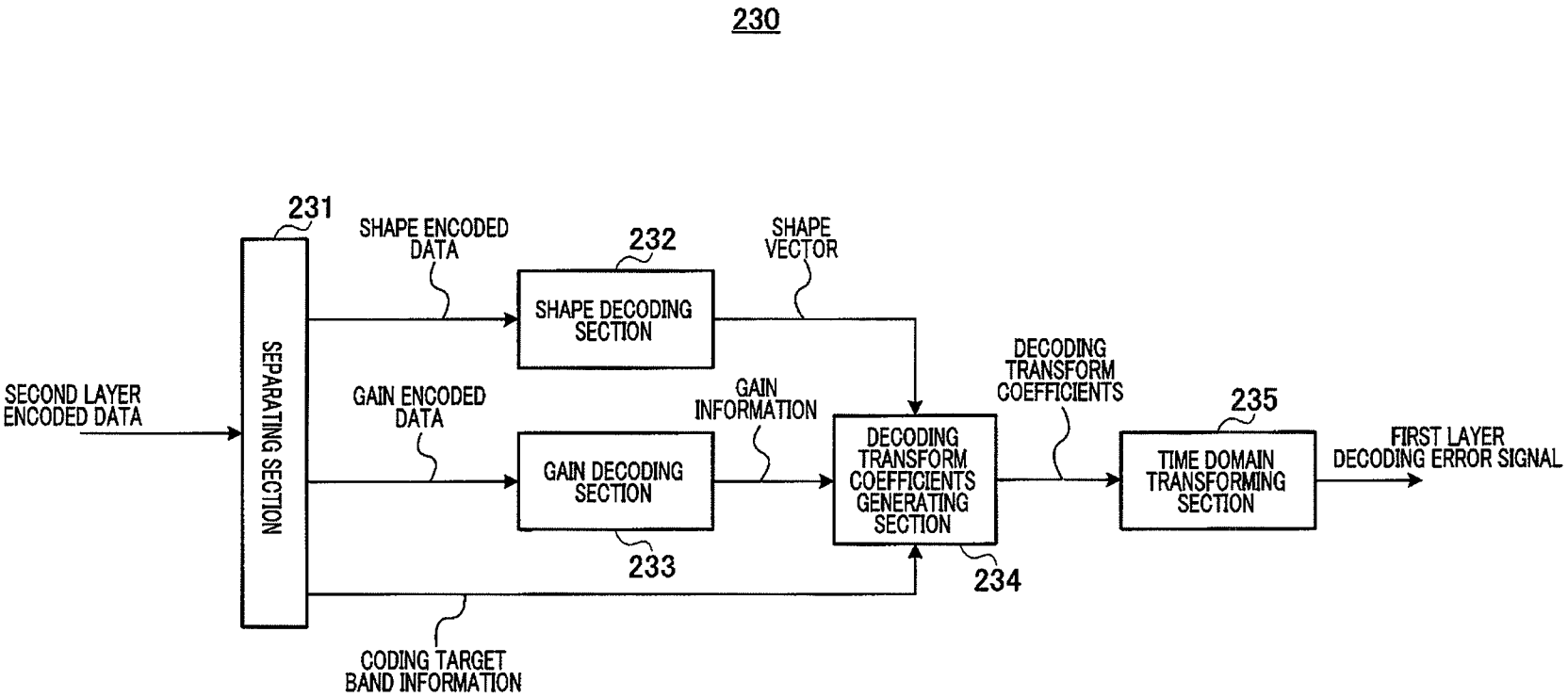
FIG. 10 is a diagram showing an internal configuration of a second layer decoding section.

FIG. 10 is a diagram showing an internal configuration of second layer decoding section 230.

Separating section 231 separates the second layer encoded data inputted by separating section 210 into shape encoded data, gain encoded data, and coding target band information. Then, separating section 231 outputs the shape encoded data to shape decoding section 232, outputs the gain encoded data to gain decoding section 233, and outputs the coding target band information to decoding transform coefficients generating section 234. Note that separating section 231 is not an indispensable component. The second layer encoded data may be separated into the shape encoded data, the gain encoded data, and the coding target band information in the separation process of separating section 210, and the separated pieces of data and information may be given directly to shape decoding section 232, gain decoding section 233, and decoding transform coefficients generating section 234, respectively.

Shape decoding section 232 generates a shape vector of decoding transform coefficients with the use of the shape encoded data given by separating section 231, and outputs the generated shape vector to decoding transform coefficients generating section 234.

Gain decoding section 233 generates gain information on decoding transform coefficients with the use of the gain encoded data given by separating section 231, and outputs the generated gain information to decoding transform coefficients generating section 234.

Decoding transform coefficients generating section 234 multiplies the shape vector by the gain information, and places the shape vector that has been multiplied by the gain information, in a band indicated by the coding target band information, to thereby generate decoding transform coefficients. Then, decoding transform coefficients generating section 234 outputs the generated decoding transform coefficients to time domain transforming section 235.

Time domain transforming section 235 transforms the decoding transform coefficients into a time domain to thereby generate a first layer decoding error signal, and outputs the generated first layer decoding error signal.

Figure 11:
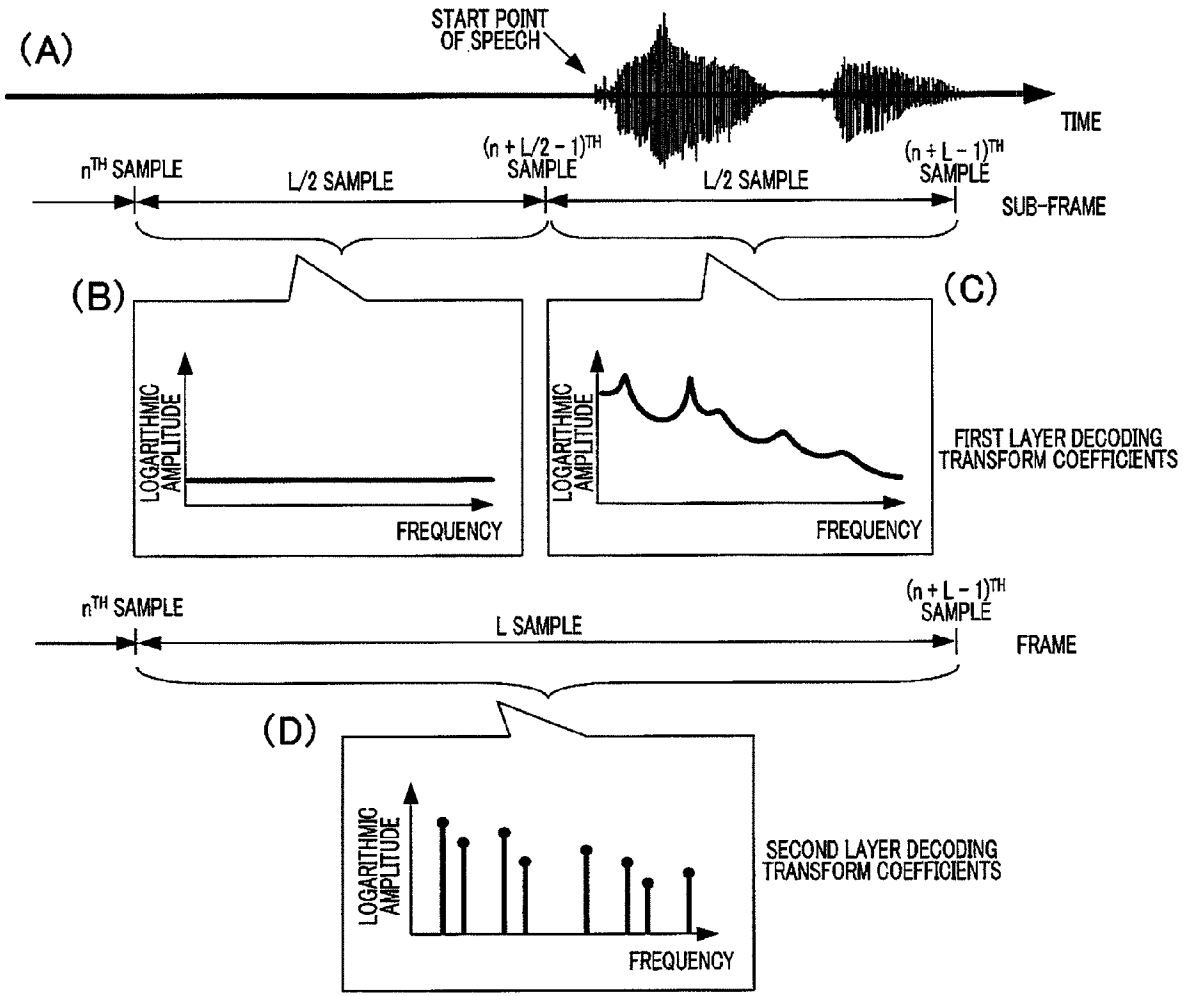
FIG. 11 is a diagram showing states of an input signal, first layer decoding transform coefficients, and second layer decoding transform coefficients according to a conventional method.
Figure 12:
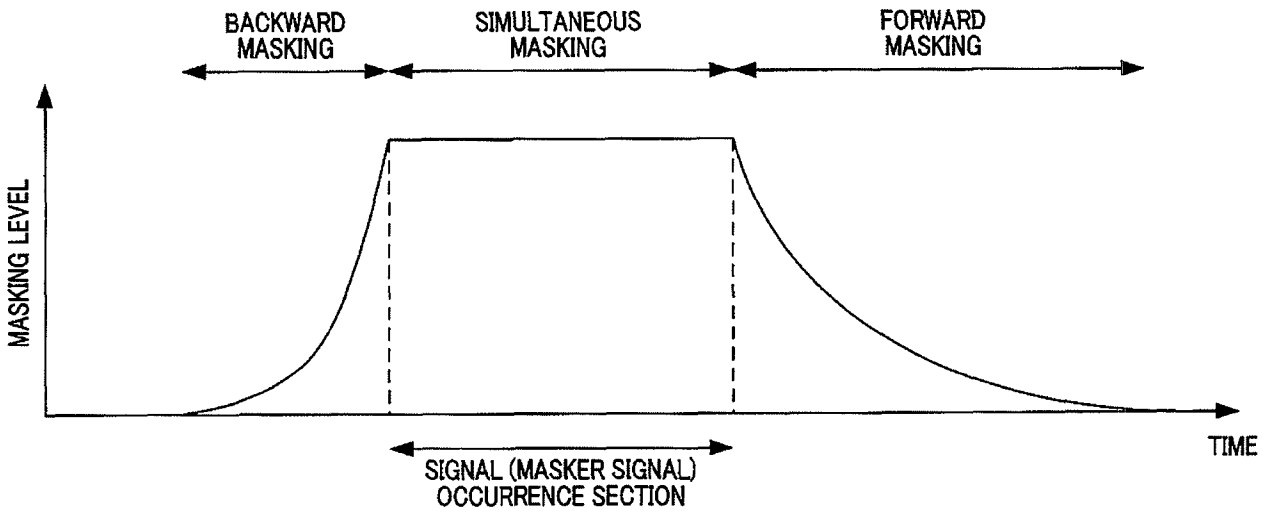
FIG. 12 is a chart for describing temporal masking as a human perceptual characteristic.
Figure 13:
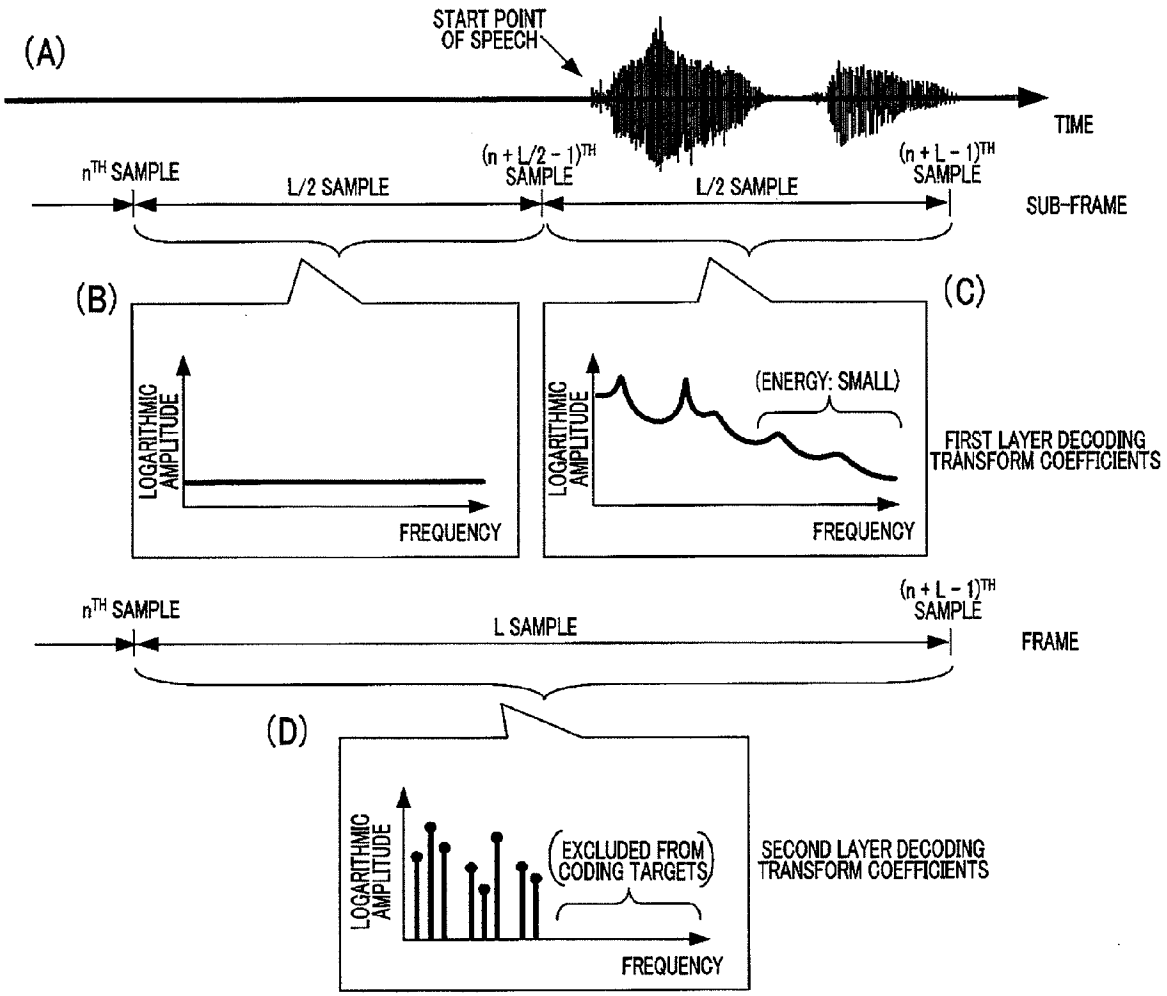
FIG. 13 is a diagram showing states of an input signal, first layer decoding transform coefficients, and second layer decoding transform coefficients according to the present embodiment.

Next, with reference to FIG. 11, FIG. 12, and FIG. 13, problems to be solved by the present invention and effects obtained thereby are described. Note that description is given below of an example case where coding apparatus 100 performs coding for each frame of an L sample. As described above, first layer coding section 110 performs coding with high temporal resolution, and second layer coding section 160 performs coding with low temporal resolution. Accordingly, description is given below of an example case where first layer coding section 110 adopts a CELP coding system in which excitation is encoded on a sub-frame basis of the L/2 sample and where second layer coding section 160 adopts a transform coding system in which transform coefficients are encoded on a frame basis of the L sample.

FIG. 11 shows states of an input signal, first layer decoding transform coefficients, and second layer decoding transform coefficients when scalable coding and decoding are performed according to a conventional method.

FIG. 11(A) shows the input signal of the coding apparatus. As is apparent from FIG. 11(A), a speech signal (or a music signal) is observed in the middle of the second sub-frame.

First, the coding process is performed on the input signal by the first layer coding section, so that the first layer encoded data is generated. The decoding transform coefficients (first layer decoding transform coefficients) of the decoded signal generated by decoding the first layer encoded data have twice as high temporal resolution as that of the second layer coding section. In the $n^{th}$ sample to the $(n+L/2-1)^{th}$ sample, a spectrum (see FIG. 11(B)) corresponding to an inactive speech section is generated. In the $(n+L/2-1)^{th}$ sample to the $(n+L-1)^{th}$ sample, a spectrum (see FIG. 11(C)) corresponding to an active speech section is generated.

Then, the transform coefficients are encoded by the second layer coding section on a frame basis of the L sample, so that the second layer encoded data is generated. Accordingly, the second layer encoded data is decoded, whereby the second layer decoding transform coefficients corresponding to the $n^{th}$ sample to the $(n+L-1)^{th}$ sample are generated (see FIG. 11(D)). Then, the second layer decoding transform coefficients are transformed into a time domain, whereby the second layer decoded signal is generated in a section corresponding to the $n^{th}$ sample to the $(n+L-1)^{th}$ sample. As a result, in the $n^{th}$ sample to the $(n+L/2-1)^{th}$ sample, the spectrum of the final decoded signal is a spectrum obtained by adding FIG. 11(B) to FIG. 11(D). In the $(n+L/2-1)^{th}$ sample to the $(n+L-1)^{th}$ sample, the spectrum thereof is a spectrum obtained by adding FIG. 11(C) to FIG. 11(D).

At this time, even in the $n^{th}$ sample to the $(n+L/2-1)^{th}$ sample, which should be an inactive speech section originally, the spectra shown in FIGS. 11(B) and (D) unfavorably occur. Because signal components in (B) of FIG. 11 are ignorable, substantially, the decoded signal based on the spectrum in FIG. 11(D) is generated. This signal is perceived as pre-echoes, and leads to a decrease in quality of the decoded signal.

In the present embodiment, the decrease in quality of the decoded signal is avoided by utilizing temporal masking as a human perceptual characteristic. The temporal masking here refers to masking that occurs when two sounds, that is, a masked signal (maskee signal) and a masking signal (masker signal) are successively given. Humans have difficulty in perceiving a feeble sound existing before or after a strong sound, and a maskee signal is hindered by a masker signal to become difficult to hear.

In such temporal masking, a phenomenon in which a maskee signal preceding a masker signal is masked is referred to as backward masking, and a phenomenon in which a maskee signal following a masker signal is masked is referred to as forward masking. Note that a phenomenon in which a masker signal and a maskee signal occur in a given time zone and the maskee signal is masked by the masker signal is referred to as simultaneous masking.

FIG. 12 shows an example of the masking level of a masker signal masking a maskee signal in each of such backward masking, forward masking, and simultaneous masking as described above.

In the present embodiment, the perceptual decrease in quality caused by pre-echoes is avoided by utilizing the backward masking of the temporal masking.

Specifically, the following principle is utilized. In a band having large energy of a decoding spectrum of a lower layer, pre-echoes occurring in a higher layer become more difficult to hear by a human perceptual sense owing to the backward masking effect. In contrast, in a band having small energy of the decoding spectrum of the lower layer, the backward masking effect cannot be obtained, and hence the pre-echoes become easier to hear. That is, in the present invention, with the utilization of this principle, a spectrum of the higher layer that is contained in the band having small energy of the decoding spectrum of the lower layer is excluded from the coding targets of the higher layer, whereby the decoding spectrum of the higher layer is not generated in the band in which the pre-echoes are easily heard. As a result, the pre-echoes occur only in the band having large energy of the decoding spectrum of the lower layer, where the backward masking effect can be obtained, and hence the perceptual decrease in quality caused by the pre-echoes can be avoided.

FIG. 13 shows states of an input signal, first layer decoding transform coefficients, and second layer decoding transform coefficients when scalable coding and decoding are performed according to the present embodiment.

Figure 1:
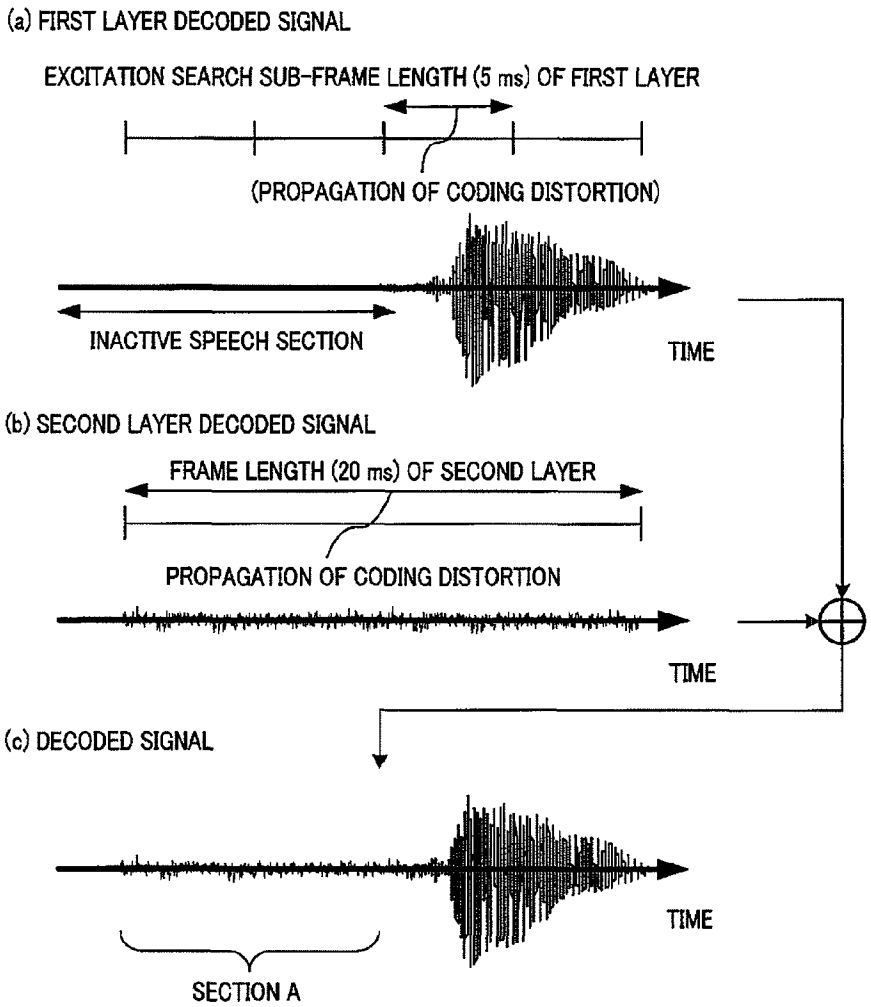
FIG. 1 is a diagram showing a state where a decoded signal is generated in the case of encoding and decoding the start point of a speech signal with the use of scalable coding including two layers.

FIG. 13(A) shows the input signal of coding apparatus 100. Similarly to FIG. 1(A) 1, a speech signal (or a music signal) is observed in the middle of the second sub-frame.

First, the coding process is performed on the input signal by first layer coding section 110, so that the first layer encoded data is generated. The decoding transform coefficients (first layer decoding transform coefficients) of the decoded signal generated by decoding the first layer encoded data have twice as high temporal resolution as that of second layer coding section 160. In the $n^{th}$ sample to the $(n+L/2-1)^{th}$ sample, a spectrum (see FIG. 13(B)) corresponding to an inactive speech section is generated. In the $(n+L/2-1)^{th}$ sample to the $(n+L-1)^{th}$ sample, a spectrum (see FIG. 13(C)) corresponding to an active speech section is generated.

In the present embodiment, frequency domain transforming section 162 transforms the first layer decoded signal obtained by first layer decoding section 120 having high temporal resolution, into a frequency domain, to thereby calculate the first layer decoding transform coefficients, and band selecting section 163 obtains a band having small energy of the spectrum (see FIG. 13(C)), from the calculated first layer decoding transform coefficients. Then, band selecting section 163 selects the obtained band as a band (exclusion band) to be excluded from the coding targets of second layer coding section 160, and sets each band other than the exclusion band as the second coding target band. Then, second layer coding section 160 performs the coding process on the second coding target band (FIG. 13(D)).

As a result, in the case where the first layer decoding transform coefficients in FIG. 13(C) serve as a masker signal and where pre-echoes occurring in second layer coding section 160 serve as a maskee signal, the pre-echoes become difficult to hear by a human auditory sense owing to the backward masking effect, in the band having large energy of the first layer decoding transform coefficients. Thus, even if the second layer decoding transform coefficients of the pre-echoes is placed in the second coding target band having a large backward masking effect, the decoded signal (pre-echoes) become difficult to perceive. That is, the pre-echoes occurring from the $n^{th}$ sample to the start point of the speech become difficult to hear, and hence the decrease in quality of the decoded signal can be avoided.

Figure 14:
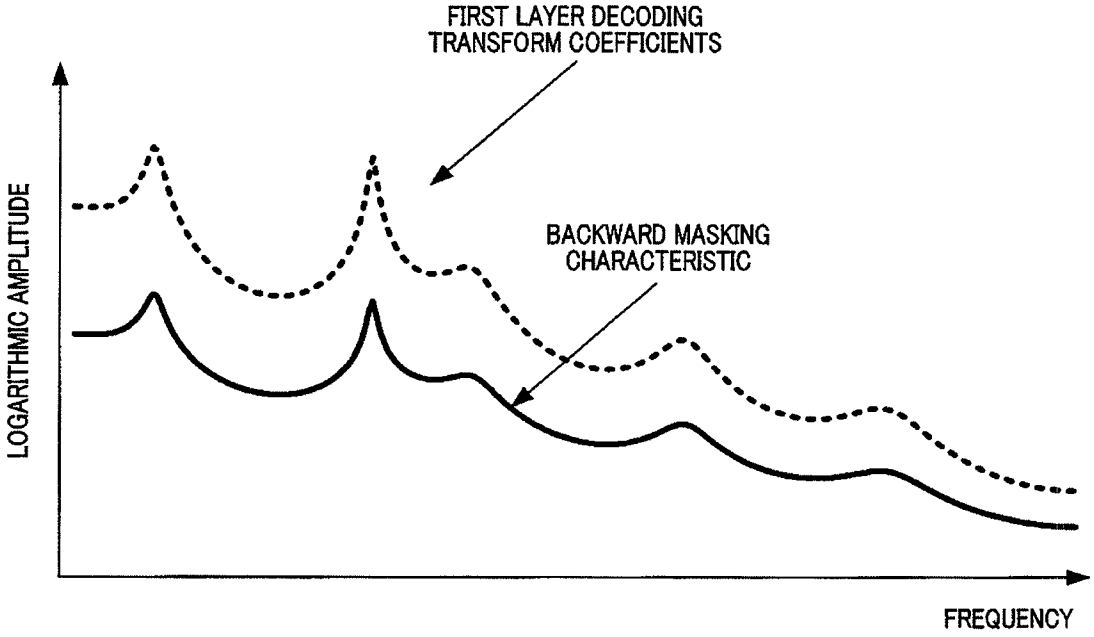
FIG. 14 is a chart showing a state of backward masking when the first layer decoding transform coefficients are a masker signal.

FIG. 14 shows a backward masking characteristic when the first layer decoding transform coefficients serve as a masker signal. As shown in FIG. 14, as the first layer decoding transform coefficients are larger, the backward masking effect is larger. Hence, the coding target band of second layer coding section 160 is set to only a band whose first layer decoding transform coefficients are larger than a predetermined threshold value, whereby the pre-echoes are masked by the first layer decoding transform coefficients.

Hereinabove, how to avoid pre-echoes occurring at the start point of the speech is described, but the present invention can also be applied to post-echoes occurring at the end point of the speech.

Figure 15:
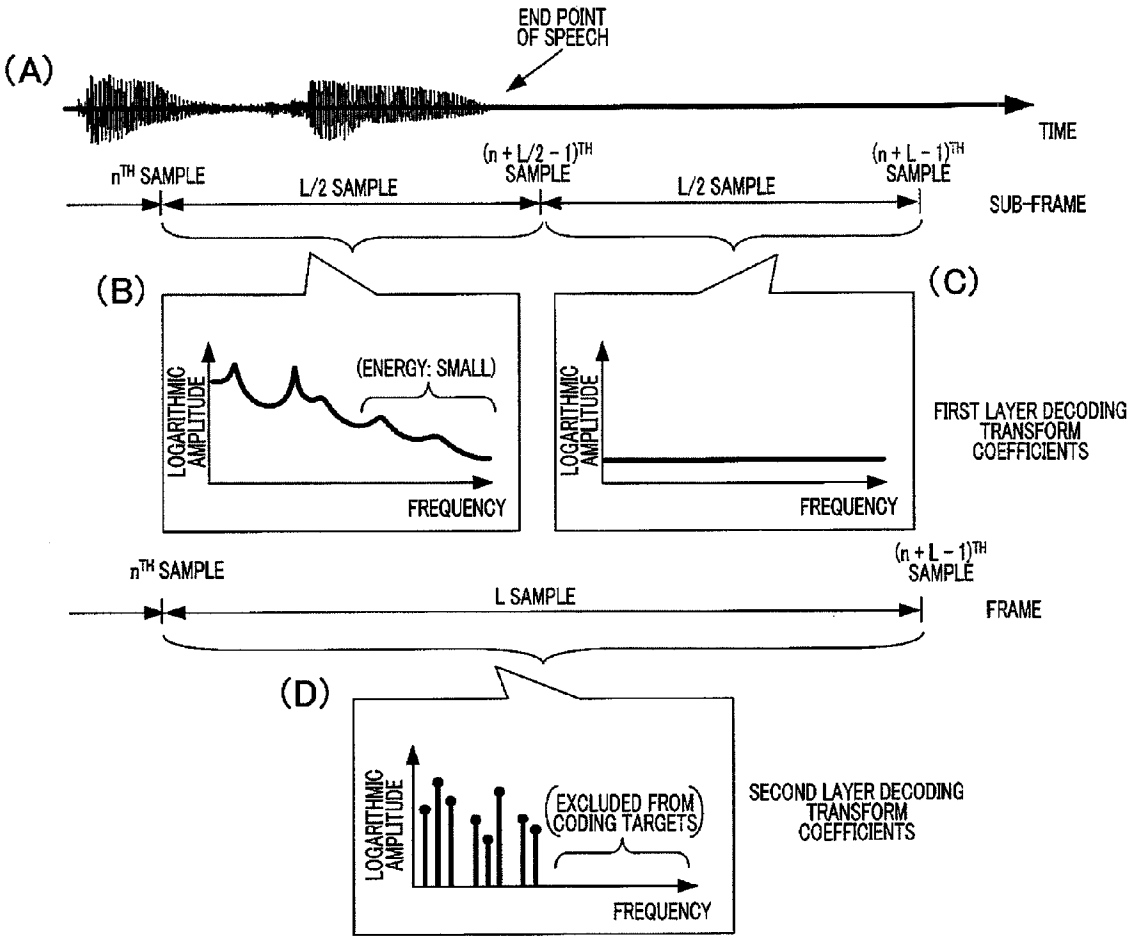
FIG. 15 is a diagram showing an example in which the present invention is applied to post-echoes.

FIG. 15 shows states of an input signal, first layer decoding transform coefficients, and second layer decoding transform coefficients when the present invention is applied to post-echoes.

With regard to the pre-echoes, the perception thereof is controlled by utilizing the backward masking, whereas, with regard to the post-echoes, the perception thereof is controlled by utilizing the forward masking. Specifically, an end point detecting section (omitted from the drawings) is used instead of start point detecting section 150. The end point detecting section detects, using the first layer decoded signal, whether or not the signal contained in the frame that is currently subjected to the coding process is the end point of an active speech portion, and outputs the detection result as end point detection information to second layer coding section 160. Then, if the signal contained in the frame that is currently subjected to the coding process is the end point of the active speech portion, band selecting section 163 obtains a band having small energy (see FIG. 15(B)), from the first layer decoding transform coefficients obtained by first layer coding section 110 having high temporal resolution. Then, band selecting section 163 selects the obtained band as a band (exclusion band) to be excluded from the coding targets of second layer coding section 160, and sets each band other than the exclusion band as the second coding target band. Then, second layer coding section 160 performs the coding process on the second coding target band (FIG. 15(D)). As a result, the perception of the post-echoes can be suppressed, and the decrease in quality of the decoded signal can be avoided.

As described above, in the present embodiment, start point detecting section 150 (or the end point detecting section) determines the start point (or the end point) of an active speech portion of a lower layer decoded signal. If the start point (or the end point) is determined, second layer coding section 160 selects a band to be excluded from the coding targets, on the basis of energy of the spectrum of the first layer decoded signal, and excludes the selected band to encode an error signal. In this way, the decrease in quality of the decoded signal can be avoided by utilizing temporal masking as a human perceptual characteristic, and the occurrence of pre-echoes (or post-echoes) caused by the higher layer having low temporal resolution can be suppressed, so that a coding system with high subjective quality can be provided.

In addition, because a band having small energy of the first layer decoding transform coefficients is excluded from the coding targets of second layer coding section 160, the transform coefficients of the other bands can be expressed more accurately. For example, the number of pulses placed in the coding target band of second layer coding section 160 can be increased. In this case, the sound quality of the decoded signal can be improved.

Note that description is given above of an example method in which the band (exclusion band) to be excluded from the coding targets of second layer coding section 160 is selected in accordance with the magnitude of energy of the first layer decoding transform coefficients, but the present invention is not limited to this method. For example, the exclusion band may be selected in accordance with the magnitude of a relative value of sub-band energy to the maximum sub-band energy. According to this method, stable processing can be performed without depending on the signal level, and pre-echoes occurring at the start point of speech or post-echoes occurring at the end point of speech can be avoided, so that the sound quality can be improved.

In addition, because the coding target band of second layer coding section 160 is limited in accordance with the first layer decoding transform coefficients, the spectrum of the coding target band of second layer coding section 160 can be expressed more accurately by, for example, increasing the number of pulses in the coding target band, so that the sound quality can be improved.

(Embodiment 2)

In Embodiment 1, the band (exclusion band) to be excluded from the coding targets of the second layer coding section is determined using the first layer decoded signal. In the present embodiment, a linear predictive coding (LPC) spectrum (spectral envelope) is obtained using LPC coefficients obtained by the first layer coding section, and the exclusion band is determined using this LPC spectrum. Such use of the LPC spectrum can also produce an effect similar to that of Embodiment 1. Further, in the present embodiment, the LPC spectrum is used instead of the spectrum of the decoded signal, and hence the sound quality can be improved with a smaller amount of calculation, compared with Embodiment 1.

Figure 16:
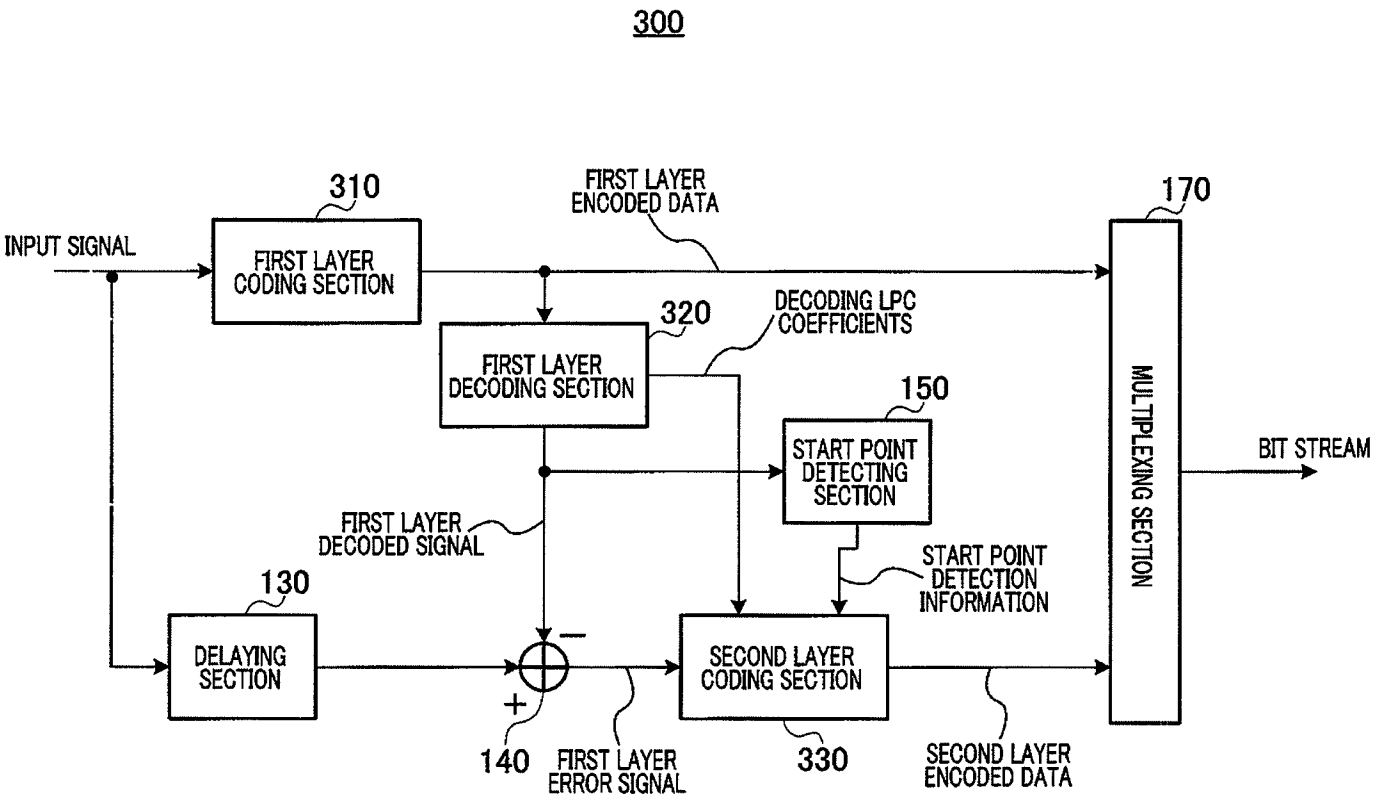
FIG. 16 is a diagram showing a main part configuration of a coding apparatus according to Embodiment 2 of the present invention.

FIG. 16 is a block diagram showing a main part configuration of a coding apparatus according to the present embodiment. Note that, in coding apparatus 300 of FIG. 16, components common to those of coding apparatus 100 of FIG. 2 are denoted by the same reference signs as those of FIG. 2, and description thereof is omitted. Note that the configuration of a decoding apparatus according to the present embodiment is the same as that of FIG. 9 and FIG. 10, and hence description thereof is omitted here.

First layer coding section 310 performs a coding process of an input signal, and generates first layer encoded data. Note that, in the present embodiment, first layer coding section 310 performs coding using the LPC coefficients.

First layer decoding section 320 performs a decoding process using the first layer encoded data, generates a first layer decoded signal, and outputs the generated first layer decoded signal to subtracting section 140 and start point detecting section 150.

First layer decoding section 320 outputs decoding LPC coefficients generated in the decoding process for the first layer decoded signal, to second layer coding section 330.

Figure 17:
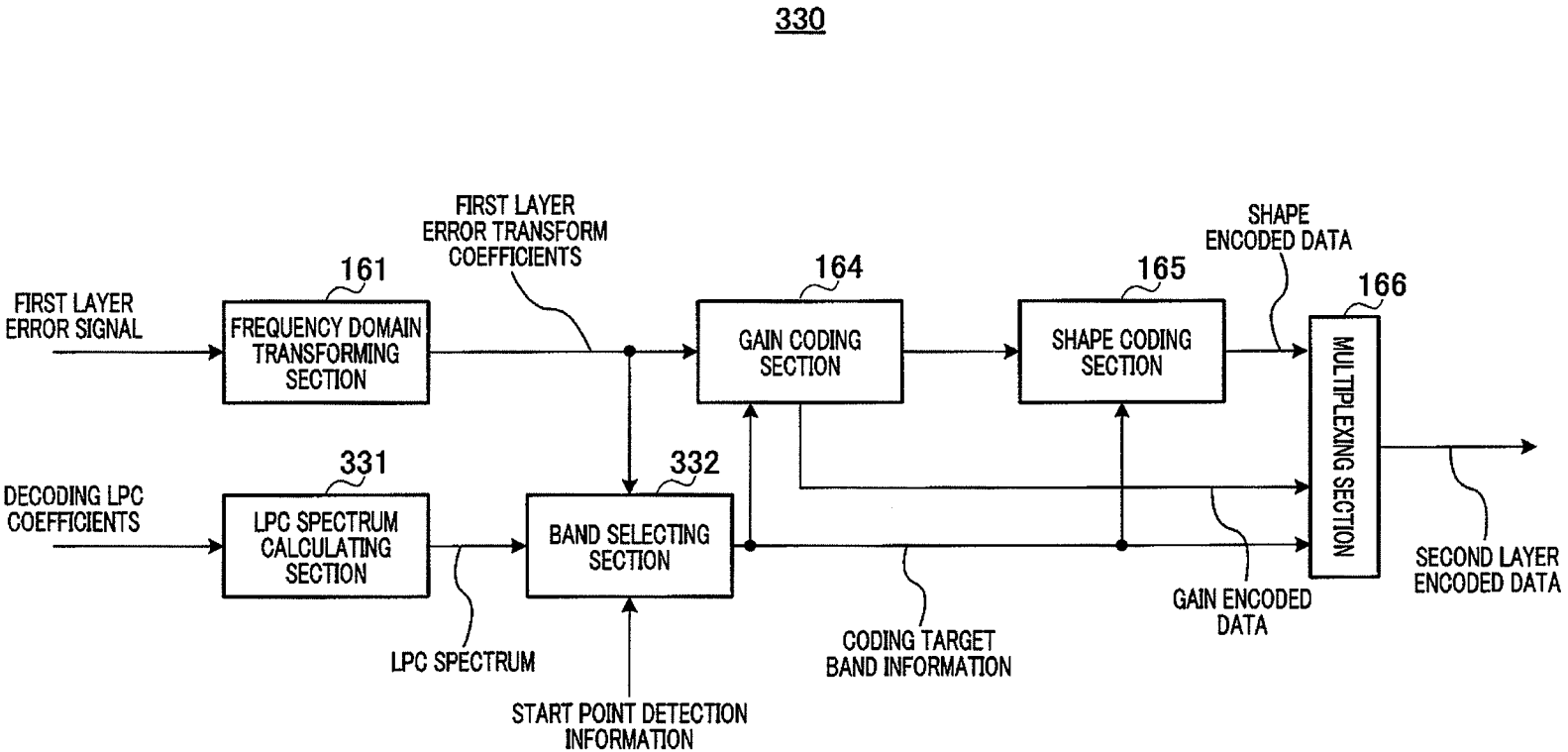
FIG. 17 is a diagram showing an internal configuration of a second layer coding section.

FIG. 17 is a diagram showing an internal configuration of second layer coding section 330. Note that, in second layer coding section 330 of FIG. 17, components common to those of second layer coding section 160 of FIG. 4 are denoted by the same reference signs as those of FIG. 4, and description thereof is omitted.

LPC spectrum calculating section 331 obtains an LPC spectrum with the use of the decoding LPC coefficients inputted by first layer decoding section 320. The LPC spectrum expresses a rough shape (spectral envelope) of the spectrum of the first layer decoded signal.

Band selecting section 332 selects a band (exclusion band) to be excluded from the coding target bands of second layer coding section 330, with the use of the LPC spectrum inputted by LPC spectrum calculating section 331. Specifically, band selecting section 332 obtains energy of the LPC spectrum, and selects a band whose obtained energy is smaller than a predetermined threshold value, as the exclusion band. Alternatively, band selecting section 332 may select a band whose ratio of energy to the maximum energy of the LPC spectrum is lower than a predetermined threshold value, as the exclusion band.

In this way, band selecting section 332 selects a band to be excluded from the coding targets of second layer coding section 330, and outputs information (coding target band information) indicating each band (second layer coding target band), which is other than the selected band and corresponds to the coding target, to gain coding section 164, shape coding section 165, and multiplexing section 166.

Subsequently, in the same manner as in Embodiment 1, second layer encoded data is generated by gain coding section 164, shape coding section 165, and multiplexing section 166.

As described above, in the present embodiment, first layer coding section 310 performs the coding using the LPC coefficients, and second layer coding section 330 selects a band having small energy of the spectrum of the LPC coefficients, as the band to be excluded from the coding target bands. As a result, the band having small energy, that is, the band to be excluded from the coding target bands can be determined with a smaller amount of calculation compared with the case of calculating the spectrum of the first layer decoded signal.

Note that, in this case, the LPC spectrum and energy thereof may be calculated only for the limited number of frequencies, and the band to be excluded from the coding target bands may be determined using the energy thus calculated. In this way, frequencies (or bands) are limited to some extent, and the coding target band is determined, whereby the band can be determined with a still smaller amount of calculation.

(Embodiment 3)

In Embodiment 1 and Embodiment 2, the coding apparatus transmits, to the decoding apparatus, the coding target band information indicating the actual coding target band of the second layer coding section, the actual coding target band being set by the band selecting section. In the present embodiment, on the basis of information obtained commonly between the coding apparatus and the decoding apparatus, each apparatus sets the actual coding target band of the second layer coding section (second layer coding target band). This can reduce the amount of information transmitted from the coding apparatus to the decoding apparatus.

A main part configuration of a coding apparatus according to the present embodiment is similar to that of Embodiment 1, and hence description is given with reference to FIG. 2. The present embodiment is different from Embodiment 1 in an internal configuration of the second layer coding section. Accordingly, in the following description, a second layer coding section according to the present embodiment is denoted by 160A.

Figure 18:
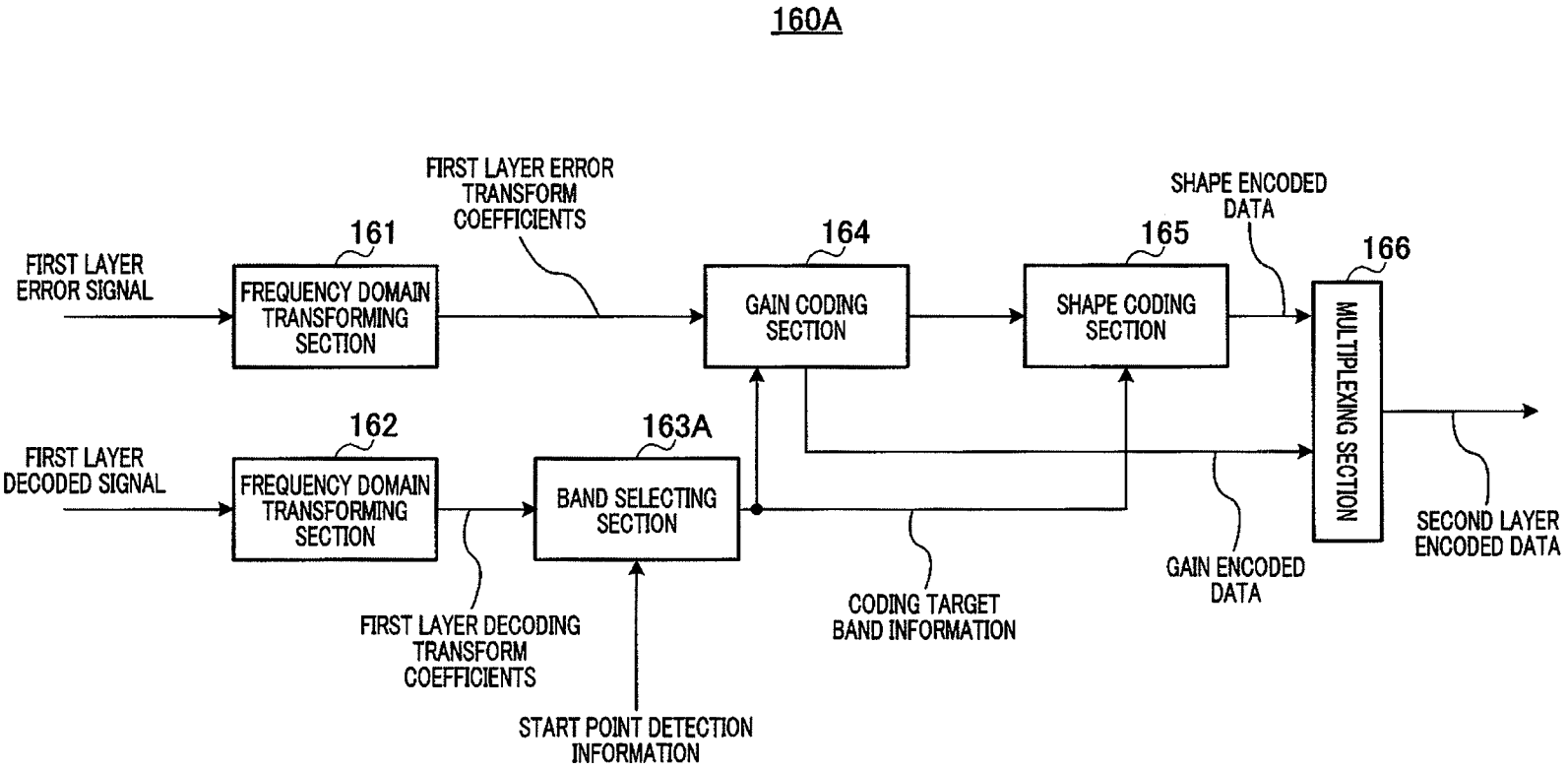
FIG. 18 is a diagram showing an internal configuration of a second layer coding section according to Embodiment 3 of the present invention.

FIG. 18 is a diagram showing an internal configuration of second layer coding section 160A according to the present embodiment. Note that, in second layer coding section 160A of FIG. 18, components common to those of second layer coding section 160 of FIG. 4 are denoted by the same reference signs as those of FIG. 4, and description thereof is omitted.

If the start point detection information indicates 1, that is, if the signal contained in the frame that is currently subjected to the coding process is the start point of the active speech portion, band selecting section 163A selects a sub-band to be excluded from the coding targets of gain coding section 164 and shape coding section 165 at the subsequent stage. Note that, in the present embodiment, band selecting section 163A does not use the first layer error transform coefficients, but uses only the first layer decoding transform coefficients, and selects a sub-band to be excluded from the coding target bands. Specifically, band selecting section 163A divides the first layer decoding transform coefficients into a plurality of sub-bands, excludes a sub-band whose energy of the first layer decoding transform coefficients is smaller than a predetermined threshold value, from the coding target bands of second layer coding section 160A, and sets each sub-band that remains without being excluded, as an actual coding target band. Band selecting section 163A outputs, to gain coding section 164 and shape coding section 165, information (coding target band information) indicating each band (second layer coding target band), which is other than the sub-band selected as a band to be excluded from the coding targets of second layer coding section 160A (gain coding section 164 and shape coding section 165) and corresponds to the coding target.

Note that band selecting section 163A may adaptively use different threshold values in accordance with characteristics (for example, speech- or music-related, or stationary or non-stationary) of the input signal.

Figure 19:
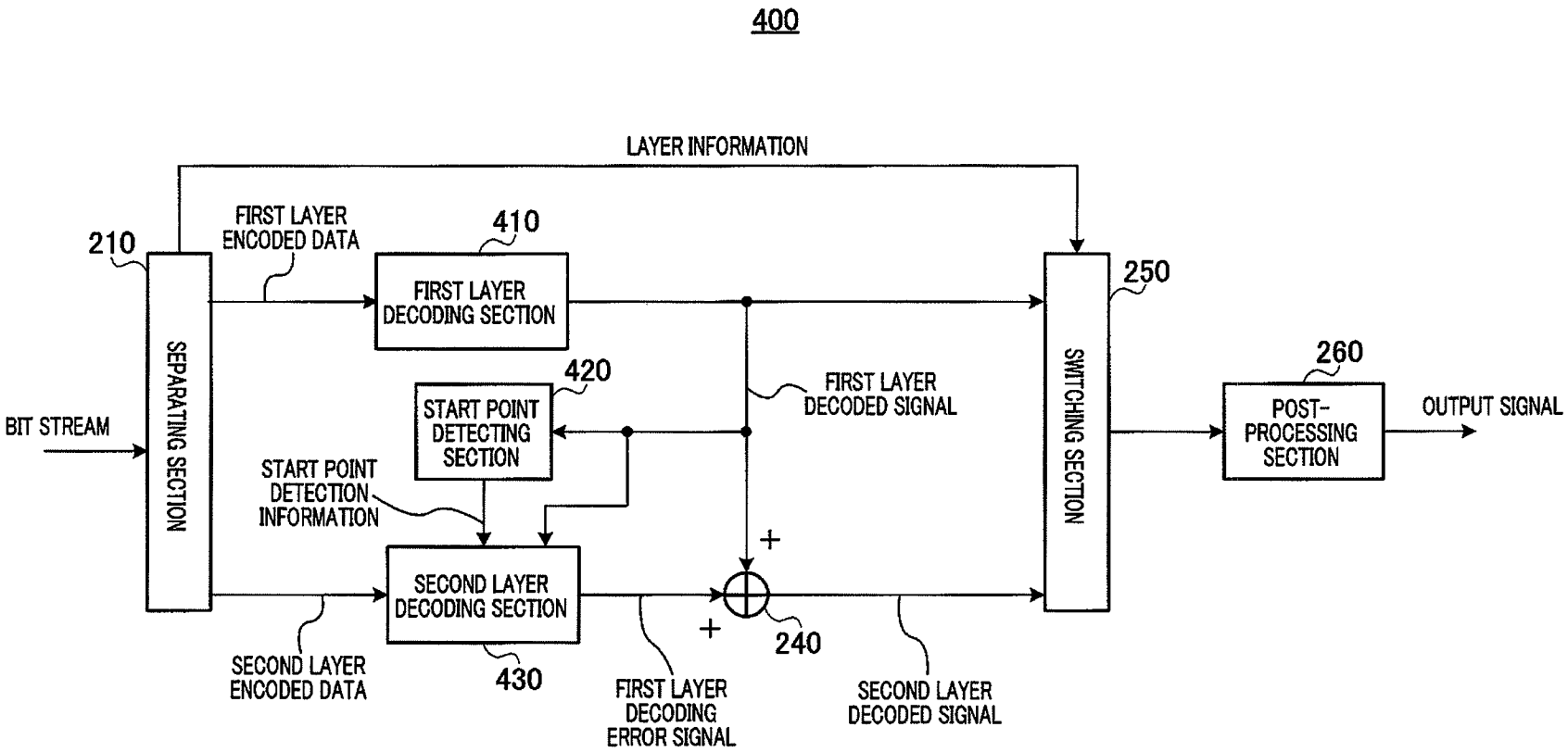
FIG. 19 is a block diagram showing a main part configuration of a decoding apparatus according to Embodiment 3.

FIG. 19 is a block diagram showing a main part configuration of a decoding apparatus according to the present embodiment. Note that, in decoding apparatus 400 of FIG. 19, components common to those of decoding apparatus 200 of FIG. 9 are denoted by the same reference signs as those of FIG. 9, and description thereof is omitted.

First layer decoding section 410 performs a decoding process using the first layer encoded data, generates a first layer decoded signal, and outputs the generated first layer decoded signal to switching section 250, start point detecting section 420, second layer decoding section 430, and adding section 240.

Start point detecting section 420 detects, using the first layer decoded signal, whether or not the signal contained in the frame that is currently subjected to the coding process is the start point of an active speech portion, and outputs the detection result as start point detection information to second layer decoding section 430. Note that start point detecting section 420 has a configuration similar to that of start point detecting section 150 of FIG. 3, and operates similarly thereto, and hence detailed description thereof is omitted.

Figure 20:
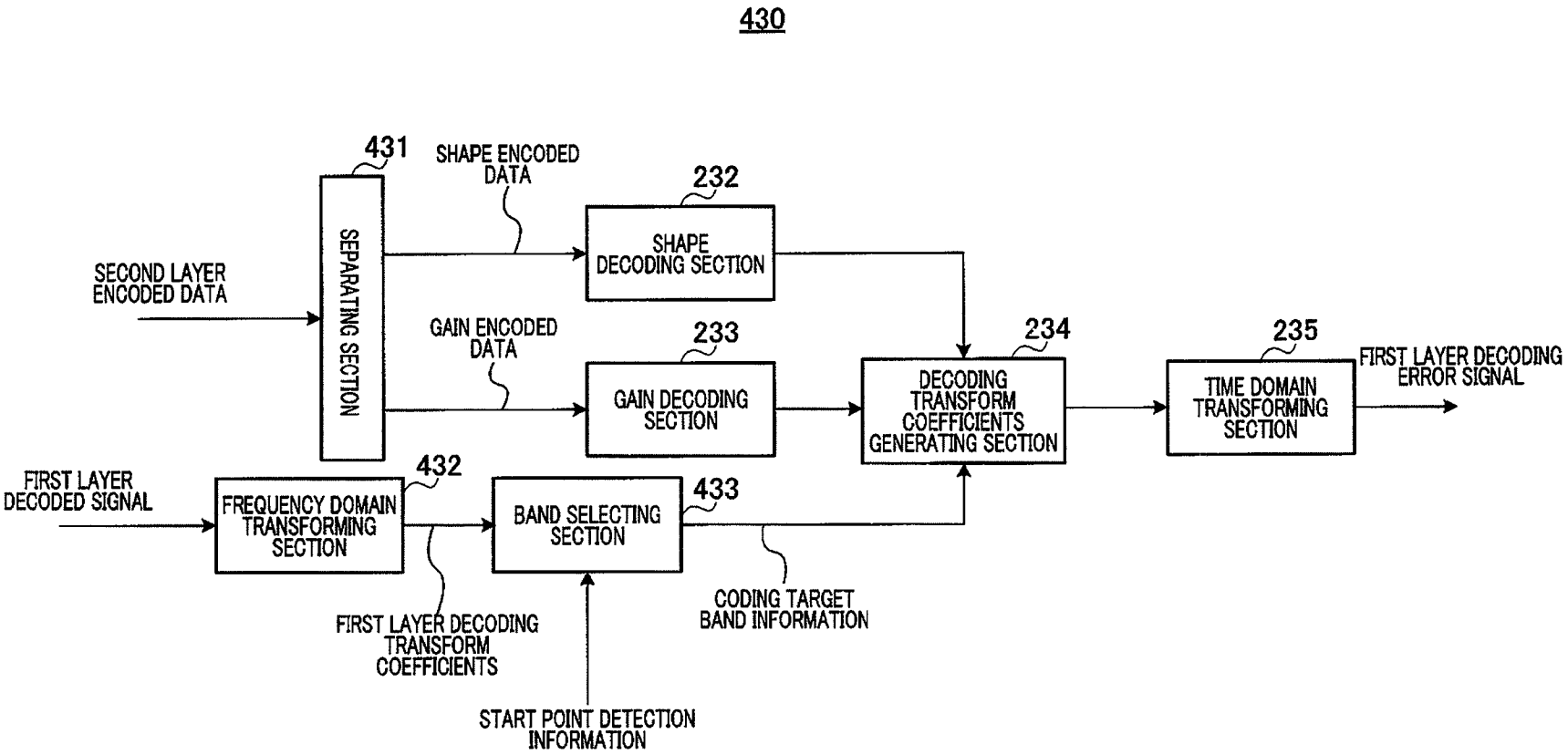
FIG. 20 is a diagram showing an internal configuration of a second layer decoding section.

FIG. 20 is a diagram showing an internal configuration of second layer decoding section 430. Note that, in second layer decoding section 430 of FIG. 20, components common to those of second layer decoding section 230 of FIG. 10 are denoted by the same reference signs as those of FIG. 10, and description thereof is omitted.

Separating section 431 separates the second layer encoded data inputted by separating section 210 into shape encoded data and gain encoded data. Then, separating section 431 outputs the shape encoded data to shape decoding section 232, and outputs the gain encoded data to gain decoding section 233. Note that separating section 431 is not an indispensable component. The second layer encoded data may be separated into the shape encoded data and the gain encoded data in the separation process of separating section 210, and the separated pieces of data may be given directly to shape decoding section 232 and gain decoding section 233, respectively.

Frequency domain transforming section 432 transforms the first layer decoded signal into a frequency domain, calculates first layer decoding transform coefficients, and outputs the calculated first layer decoding transform coefficients to band selecting section 433.

If the start point detection information indicates 1, that is, if the signal contained in the frame that is currently subjected to the decoding process is the start point of an active speech portion, band selecting section 433 selects a sub-band to be excluded from the decoding targets of shape decoding section 232 and gain decoding section 233 at the subsequent stage. Note that, in the present embodiment, similarly to band selecting section 163A, band selecting section 433 does not use the first layer error transform coefficients, but uses only the first layer decoding transform coefficients, and selects a sub-band to be excluded from the coding target bands. Note that band selecting section 433 is similar to band selecting section 163A, and hence description thereof is omitted. Band selecting section 433 outputs, to decoding transform coefficients generating section 234, information (coding target band information) indicating each band (second layer coding target band), which is other than the sub-band selected as a band to be excluded from the coding targets of second layer decoding section 430 and corresponds to the coding target.

In this way, in the present embodiment, band selecting section 163A and band selecting section 433 respectively set actual coding/decoding target bands of second layer coding section 330 and second layer decoding section 430 with the use of the first layer decoding transform coefficients. In second layer decoding section 430, the first layer decoding transform coefficients are obtained by transforming the first layer decoded signal into a frequency domain by frequency domain transforming section 432. Accordingly, without the need to report the coding target band information from coding apparatus 300 to decoding apparatus 400, decoding apparatus 400 can acquire information on the decoding target band, so that the amount of information transmitted from coding apparatus 300 to decoding apparatus 400 can be reduced.

(Embodiment 4)

In a decoding apparatus according to the present embodiment, if the start point or the end point of a speech signal is detected, the higher layer attenuates decoding transform coefficients located in a band having small energy of the spectrum of a decoded signal of the lower layer. This makes a decoding spectrum of the higher layer difficult to hear perceptually, the decoding spectrum occurring in the band having small energy of the decoding spectrum of the lower layer. That is, in the present embodiment, pre-echoes or post-echoes occurring in the higher layer are made difficult to hear on the decoding side by utilizing the temporal masking effect of the decoding spectrum of the lower layer. Accordingly, the pre-echoes or post-echoes do not need to be considered on the coding side, and a coding apparatus that performs general scalable coding can be used, so that the sound quality can be improved without particularly changing the configuration of the coding apparatus.

Figure 21:
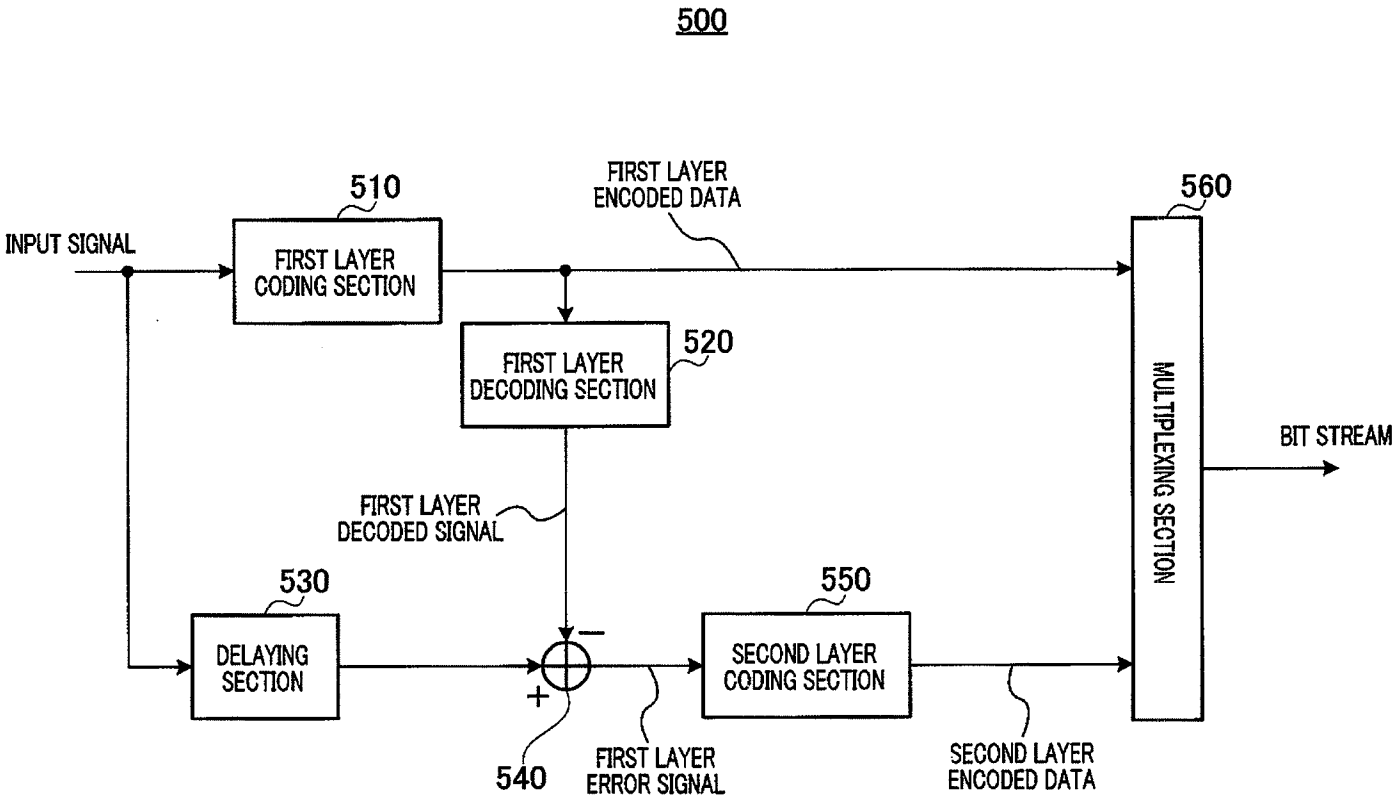
FIG. 21 is a diagram showing a main part configuration of a coding apparatus according to Embodiment 4 of the present invention.

FIG. 21 is a block diagram showing a main part configuration of coding apparatus 500 according to the present embodiment.

First layer coding section 510 performs a coding process of an input signal, and generates first layer encoded data. First layer coding section 510 outputs the first layer encoded data to first layer decoding section 520 and multiplexing section 560.

First layer decoding section 520 performs a decoding process using the first layer encoded data, generates a first layer decoded signal, and outputs the generated first layer decoded signal to subtracting section 540.

Delaying section 530 delays the input signal by an amount of time corresponding to a delay that occurs in first layer coding section 510 and first layer decoding section 520, and outputs the delayed input signal to subtracting section 540.

Subtracting section 540 subtracts, from the input signal, the first layer decoded signal generated by first layer decoding section 520 to thereby generate a first layer error signal, and outputs the first layer error signal to second layer coding section 550.

Second layer coding section 550 performs a coding process of the first layer error signal sent out from subtracting section 540, generates second layer encoded data, and outputs the second layer encoded data to multiplexing section 560.

Multiplexing section 560 multiplexes the first layer encoded data obtained by first layer coding section 510 with the second layer encoded data obtained by second layer coding section 550 to thereby generate a bit stream, and outputs the generated bit stream to a transmission channel (not shown).

Figure 22:
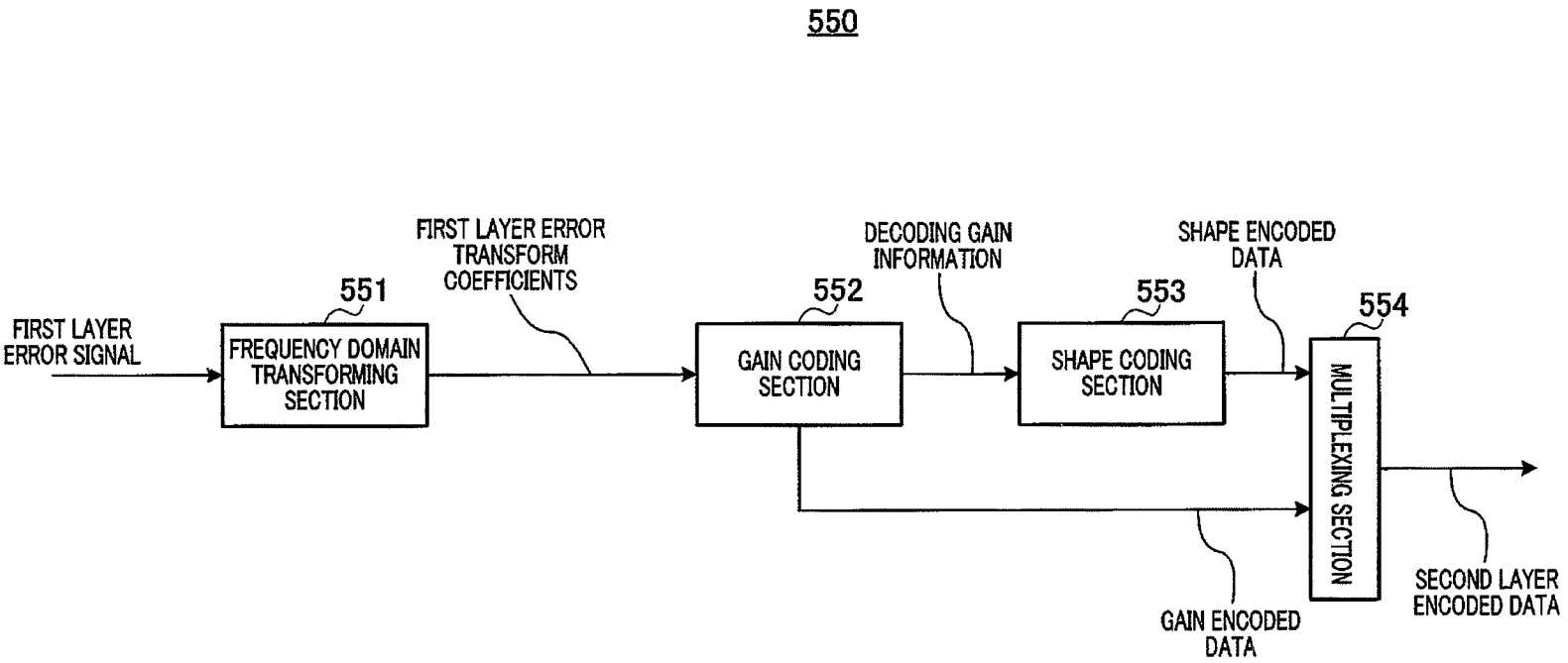
FIG. 22 is a diagram showing an internal configuration of a second layer coding section.

FIG. 22 is a diagram showing an internal configuration of second layer coding section 550.

Frequency domain transforming section 551 transforms the first layer error signal into a frequency domain, calculates first layer error transform coefficients, and outputs the calculated first layer error transform coefficients to gain coding section 552.

Gain coding section 552 calculates gain information indicating the magnitude of the first layer error transform coefficients, and encodes the gain information to thereby generate gain encoded data. Gain coding section 552 outputs the gain encoded data to multiplexing section 554. Gain coding section 552 also outputs decoding gain information obtained together with the gain encoded data, to shape coding section 553.

Shape coding section 553 generates shape encoded data indicating the shape of the first layer error transform coefficients, and outputs the generated shape encoded data to multiplexing section 554.

Multiplexing section 554 multiplexes the shape encoded data outputted by shape coding section 553 with the gain encoded data outputted by gain coding section 552, and outputs the multiplexed data as the second layer encoded data. Note that multiplexing section 554 is not indispensable, and the shape encoded data and the gain encoded data may be outputted directly to multiplexing section 560.

A main part configuration of the decoding apparatus according to the present embodiment is similar to that of Embodiment 3, and hence description is given with reference to FIG. 19. The present embodiment is different from Embodiment 3 in an internal configuration of the second layer decoding section. Accordingly, in the following description, a second layer decoding section according to the present embodiment is denoted by 430A.

Figure 23:
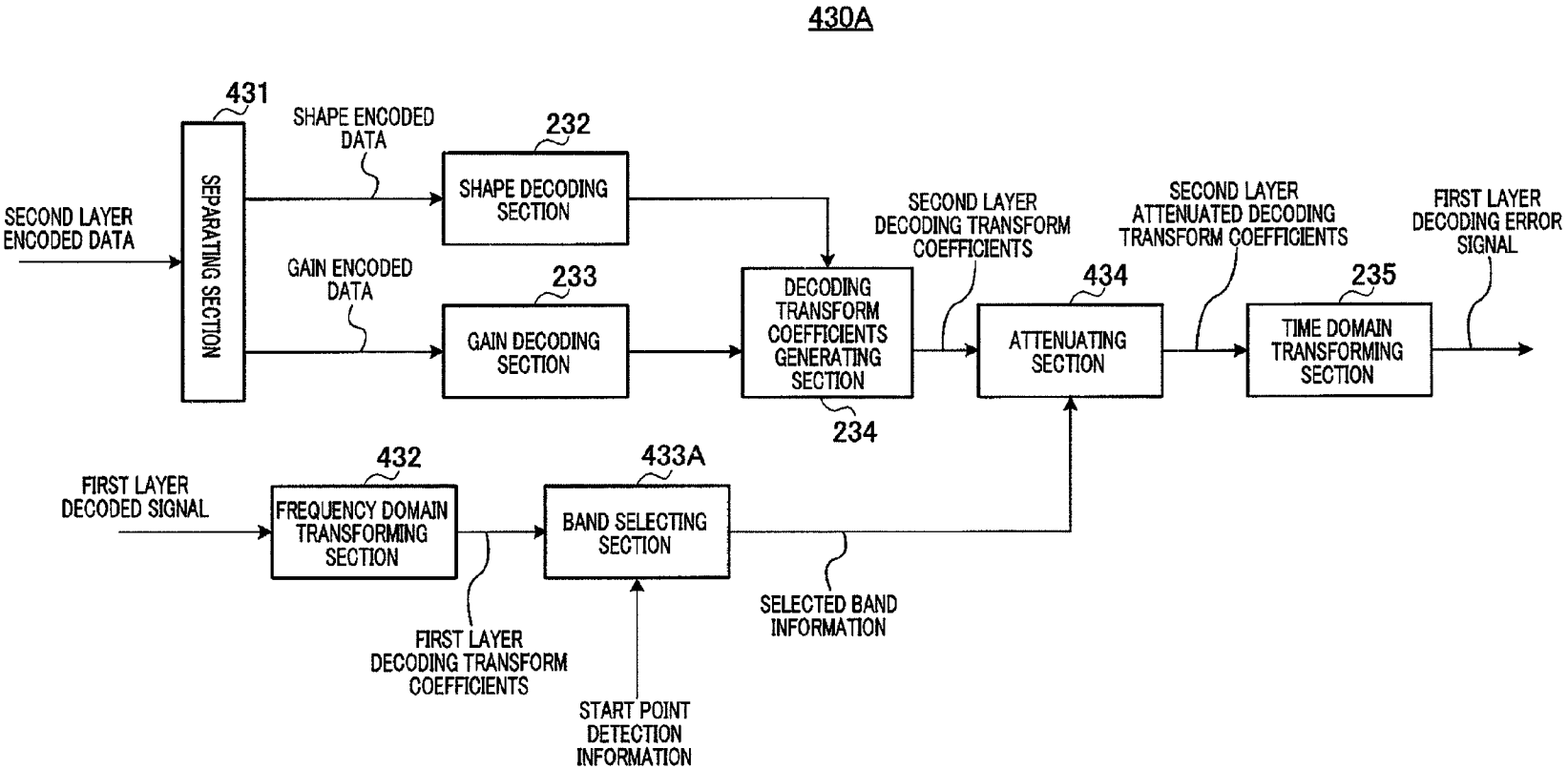
FIG. 23 is a diagram showing an internal configuration of a second layer decoding section.

FIG. 23 is a diagram showing an internal configuration of second layer decoding section 430A according to the present embodiment. Note that, in second layer decoding section 430A of FIG. 23, components common to those of second layer decoding section 430 of FIG. 20 are denoted by the same reference signs as those of FIG. 20, and description thereof is omitted.

Frequency domain transforming section 432 transforms the first layer decoded signal obtained by first layer decoding section 410 having high temporal resolution, into a frequency domain, to thereby calculate the first layer decoding transform coefficients, and band selecting section 433A obtains a band whose energy of the spectrum is smaller than a predetermined threshold value, from the calculated first layer decoding transform coefficients. Then, band selecting section 433A selects the obtained band as a band (attenuation target band) for which the second layer decoding transform coefficients are attenuated, and outputs information on the attenuation target band as selected band information to attenuating section 434.

Attenuating section 434 attenuates the magnitude of the second layer decoding transform coefficients located in the band indicated by the selected band information, and outputs the second layer decoding transform coefficients after attenuation as second layer attenuated decoding transform coefficients to time domain transforming section 235.

Figure 24:
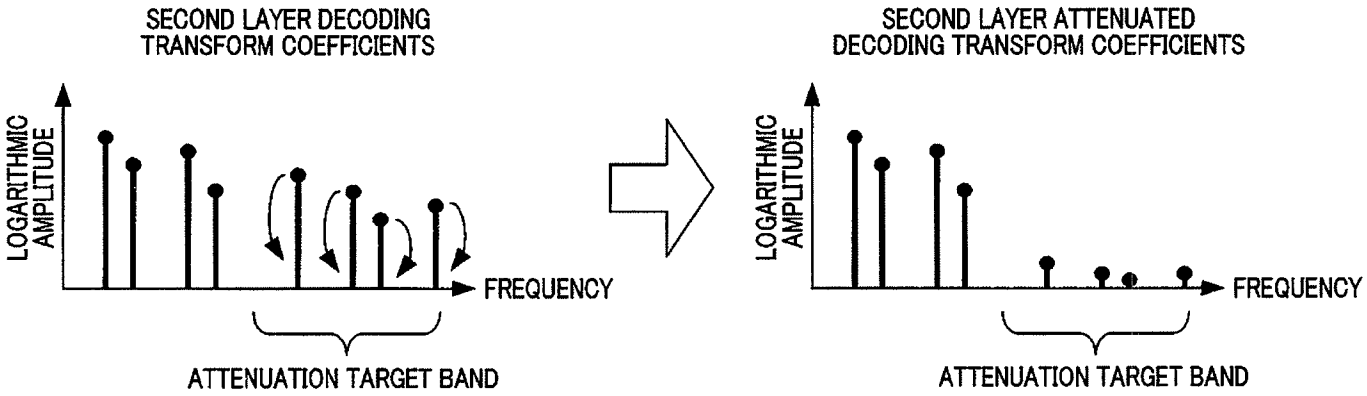
FIG. 24 is a diagram showing a state of processing in an attenuating section.

FIG. 24 is a diagram for describing processing in attenuating section 434. The left chart of FIG. 24 shows the second layer decoding transform coefficients before attenuation, and the right chart of FIG. 24 shows the second layer decoding transform coefficients after attenuation (second layer attenuated decoding transform coefficients). As shown in FIG. 24, the attenuating section attenuates the magnitude of the second layer decoding transform coefficients located in the band (attenuation target band) indicated by the selected band information.

As described above, in the present embodiment, if it is determined that the start point (or the end point) of an active speech portion of a lower layer decoded signal exists, second layer decoding section 430A selects a band for which the decoding transform coefficients of the second layer decoded signal are attenuated, on the basis of energy of the spectrum of the first layer decoded signal, and attenuates the decoding transform coefficients of the second layer decoded signal in the selected band. As a result, even if the coding process is performed on the coding side without considering pre-echoes or post-echoes, because the relation between the first layer decoding transform coefficients and the second layer decoding transform coefficients corresponds to the relation between a masker signal and a maskee signal, the pre-echoes or post-echoes can be avoided.

Hereinabove, the embodiments of the present invention are described.

Note that the scalable coding including two coding layers is described above, but the present invention can also be applied to a scalable configuration including three or more coding layers.

In addition, in the above description, the bit stream outputted by coding apparatus 100, 300, 500 is received by decoding apparatus 200, 400, but the present invention is not limited thereto. That is, instead of the bit stream generated in the configuration of coding apparatus 100, 300, 500, decoding apparatus 200, 400 can also decode a bit stream outputted by a coding apparatus that can generate a bit stream containing encoded data necessary for decoding.

In addition, examples of the used frequency transforming section include discrete Fourier transform (DFT), fast Fourier transform (FFT), discrete cosine transform (DCT), modified discrete cosine transform (MDCT), and a filter bank. In addition, both a speech signal and a music signal can be applied as the input signal.

In addition, the coding apparatus or the decoding apparatus according to each of the above-mentioned embodiments can be applied to a base station apparatus or a communication terminal apparatus. In addition, in each of the above-mentioned embodiments, description is given of an example case where the present invention is configured in the form of hardware, but the present invention can be implemented in the form of software.

In addition, the respective functional blocks used in each of the above-mentioned embodiments are implemented typically as LSI as an integrated circuit. These functional blocks may be individually implemented on a chip, or may be partially or wholly implemented on a chip. The term LSI is used here, but the term IC, system LSI, super LSI, or ultra LSI may be suitably used depending on the degree of integration.

In addition, a technique of making an integrated circuit is not limited to LSI, and such integration may be implemented using a dedicated circuit or a general-purpose processor. It is also possible to utilize: field programmable gate array (FPGA) that can be programmed after LSI production; and a reconfigurable processor in which connection and settings of circuit cells inside of LSI can be reconfigured.

Moreover, if a technique of making an integrated circuit that can replace LSI appears along with progress in semiconductor technology or other related technology, as a matter of course, the functional blocks may be integrated using the technique. For example, application of biotechnology is possible.

The disclosure of Japanese Patent Application No. 2009-241617, filed on Oct. 20, 2009, including the specification, drawings and abstract, is incorporated herein by reference in its entirety.

INDUSTRIAL APPLICABILITY

The coding apparatus, the decoding apparatus, and the like according to the present invention are suitable for use in, for example, a cellular phone, an IP phone, and a video-conference.

REFERENCE SIGNS LIST

100, 300, 500 Coding apparatus
110, 310, 510 First layer coding section
120, 220, 320, 410, 520 First layer decoding section
130, 530 Delaying section
140, 540 Subtracting section
150, 420 Start point detecting section
160, 160A, 330, 550 Second layer coding section
151 Sub-frame dividing section
152 Energy change amount calculating section
153 Detecting section
161, 162, 432, 551 Frequency domain transforming section
163, 163A, 332, 433, 433A Band selecting section
164, 552 Gain coding section
165, 553 Shape coding section
166, 170, 554, 560 Multiplexing section
200, 400 Decoding apparatus
210, 231, 431 Separating section
230, 430, 430A Second layer decoding section
240 Adding section
250 Switching section
260 Post-processing section
232 Shape decoding section
233 Gain decoding section
234 Decoding transform coefficients generating section
235 Time domain transforming section
331 LPC spectrum calculating section
434 Attenuating section

The invention claimed is:

1. A coding apparatus for scalable coding including: a lower layer coding section; and a higher layer coding section performing coding with temporal resolution lower than that of the lower layer coding section, the coding apparatus comprising:

a lower layer coding section, implemented on a chip and configured to encode an input speech or music signal to obtain a lower layer decoded signal;

a lower layer decoding section, implemented on a chip and configured to decode the lower layer encoded signal to obtain a lower layer decoded signal;

an error signal generating section, implemented on a chip and configured to obtain an error signal between the input speech or music signal and the lower layer decoded signal;

a determining section, implemented on a chip and configured to determine a start point or an end point of an active speech portion in the lower layer decoded signal;

a higher layer coding section, implemented on a chip and configured to select, if the determining section determines the start point or the end point, a band to be excluded from coding target bands, exclude the selected band to encode the error signal, and obtain a higher layer encoded signal; and a multiplexing system, implemented on a chip, configured to multiplex the lower layer encoded signal and the higher layer encoded signal and generate a bit stream and output the generated bit stream to a transmission channel.

2. The coding apparatus according to claim 1, wherein the higher layer coding section selects the band to be excluded, on a basis of energy of a spectrum of the lower layer decoded signal or energy of a spectrum of the error signal.

3. The coding apparatus according to claim 1, wherein the higher layer coding section selects, as the band to be excluded, a band whose energy of a spectrum of the lower layer decoded signal or energy of a spectrum of the error signal is the smallest or is smaller than a predetermined threshold value.

4. The coding apparatus according to claim 1, wherein the higher layer coding section calculates a perceptual masking threshold value using the lower layer decoded signal, and selects, as the band to be excluded, a band whose energy of a spectrum of the perceptual masking threshold value is the smallest or is smaller than a predetermined threshold value.

5. The coding apparatus according to claim 1, wherein:

the lower layer coding section performs coding using LPC coefficients; and the higher layer coding section selects, as the band to be excluded, a band having small energy of a spectrum of the LPC coefficients.

6. A communication terminal apparatus comprising a coding apparatus according to claim 1.

7. A base station apparatus comprising a coding apparatus according to claim 1.

8. A decoding apparatus for decoding a lower layer encoded signal and a higher layer encoded signal that are encoded by a coding apparatus for scalable coding including: a lower layer coding section; and a higher layer coding section performing coding with temporal resolution lower than that of the lower layer coding section, the decoding apparatus comprising:

a lower layer decoding section, implemented on a chip and configured to decode the lower layer encoded signal to obtain a lower layer decoded signal;

a higher layer decoding section, implemented on a chip and configured to exclude or process a band selected on a basis of a preset condition to decode the higher layer encoded signal, and obtain a decoded error signal; and an adding section implemented on a chip and configured to add the lower layer decoded signal to the decoded error signal to obtain a decoded signal.

9. The decoding apparatus according to claim 8, wherein the higher layer decoding section selects a band on a basis of energy of a spectrum of the lower layer decoded signal, excludes the selected band to decode the higher layer encoded signal, and obtains the decoded error signal.

10. The decoding apparatus according to claim 9, wherein the higher layer decoding section excludes a band whose energy of the spectrum of the lower layer decoded signal is the smallest or is smaller than a predetermined threshold value, and decodes the higher layer encoded signal.

11. The decoding apparatus according to claim 9, wherein the higher layer decoding section calculates a perceptual masking threshold value using the lower layer decoded signal, excludes a band whose energy of a spectrum of the perceptual masking threshold value is the smallest or is smaller than a predetermined threshold value, and decodes the higher layer encoded signal.

12. The decoding apparatus according to claim 9, wherein the selected band is included in the higher layer encoded signal.

13. The decoding apparatus according to claim 8, further comprising a determining section, implemented on a chip and configured to determine a start point or an end point of an active speech portion in the lower layer decoded signal, wherein the higher layer decoding section selects, if the determining section determines the start point or the end point, a band to be excluded from decoding target bands on a basis of energy of a spectrum of the lower layer decoded signal, excludes the selected band, and decodes the higher layer encoded signal.

14. The decoding apparatus according to claim 8, further comprising a determining section, implemented on a chip and configured to determine a start point or an end point of an active speech portion in the lower layer decoded signal, wherein the higher layer decoding section selects, if the determining section determines the start point or the end point, a band for which decoding transform coefficients of the decoded error signal are attenuated, and attenuates the decoding transform coefficients of the decoded error signal for the selected band to obtain the decoded error signal.

15. The decoding apparatus according to claim 14, wherein the higher layer decoding section selects the band for which the decoding transform coefficients of the decoded error signal are attenuated, on a basis of energy of a spectrum of the lower layer decoded signal.

16. A communication terminal apparatus comprising a decoding apparatus according to claim 8.

17. A base station apparatus comprising a decoding apparatus according to claim 8.

18. A coding method for scalable coding including: a lower layer coding; and a higher layer coding performing coding with temporal resolution lower than that of the lower layer, the coding method comprising:

encoding step of encoding, by a chip, an input speech or music signal to obtain a lower layer encoded signal;

decoding, by a chip, the lower layer encoded signal to obtain a lower layer decoded signal;

obtaining, by a chip, an error signal between the input signal and the lower layer decoded signal;

determining step of determining, by a chip, a start point or an end point of an active speech portion in the lower layer decoded signal;

selecting, by a chip and if the start point or the end point is determined in the determining, a band to be excluded from coding target bands, excluding the selected band to encode the error signal, and obtaining a higher layer encoded signal; and multiplexing, by a chip, the lower layer encoded signal and the higher layer encoded final and generating a bit stream and outputting the bit stream to a transmission channel.

19. A decoding method for decoding a lower layer encoded signal and a higher layer encoded signal that are encoded by a coding method for scalable coding including: a lower layer coding; and a higher layer coding performing coding with temporal resolution lower than that of the lower layer, the decoding method comprising:

decoding step of decoding, by a chip, the lower layer encoded signal to obtain a lower layer decoded signal;

excluding or processing, by a chip, a band selected on a basis of a preset condition to decode the higher layer encoded signal, and obtaining a decoded error signal; and adding, by a chip, the lower layer decoded signal to the decoded error signal to obtain a decoded signal.

* * * * *